US010375485B2

(12) United States Patent
Petersen et al.

(10) Patent No.: US 10,375,485 B2
(45) Date of Patent: Aug. 6, 2019

(54) HEARING DEVICE COMPRISING A MICROPHONE CONTROL SYSTEM

(71) Applicant: Oticon A/S, Smørum (DK)

(72) Inventors: Svend Oscar Petersen, Smørum (DK); Anders Thule, Smørum (DK); Kennet Draaby Hansen, Store Heddinge (DK)

(73) Assignee: Oticon A/S, Smørum (DK)

( * ) Notice: Subject to any disclaimer, the term of this patent is extended or adjusted under 35 U.S.C. 154(b) by 211 days.

(21) Appl. No.: 15/387,124

(22) Filed: Dec. 21, 2016

(65) Prior Publication Data

US 2017/0180878 A1 Jun. 22, 2017

(30) Foreign Application Priority Data

Dec. 22, 2015 (EP) ..... 15201857

(51) Int. Cl.
*H04R 25/00* (2006.01)

(52) U.S. Cl.
CPC ..... *H04R 25/407* (2013.01); *H04R 25/305* (2013.01); *H04R 25/356* (2013.01); *H04R 25/453* (2013.01); *H04R 2225/021* (2013.01); *H04R 2225/025* (2013.01); *H04R 2225/67* (2013.01)

(58) Field of Classification Search
CPC .. H04R 25/407; H04R 25/305; H04R 25/356; H04R 25/453; H04R 2225/021; H04R 2225/025; H04R 2225/67
USPC ..... 381/318
See application file for complete search history.

(56) References Cited

U.S. PATENT DOCUMENTS 4,718,099 A * 1/1988 Hotvet ..... H03G 3/32 381/106
2002/0057817 A1 5/2002 Darbut
2008/0095388 A1 4/2008 Theverapperuma
2009/0067651 A1 3/2009 Klinkby et al.
2010/0092016 A1 4/2010 Iwano et al.
2014/0341394 A1* 11/2014 Croft, III ..... H04R 1/2811 381/102

(Continued)

FOREIGN PATENT DOCUMENTS

EP 2 750 410 A1 7/2014
EP 2 843 971 A1 3/2015

(Continued)

*Primary Examiner* — Sean H Nguyen
(74) *Attorney, Agent, or Firm* — Birch, Stewart, Kolasch & Birch, LLP

(57) ABSTRACT

A hearing device, e.g. a hearing aid, comprises a) first and b) second input transducers located on the head, and at or in an ear canal of the user, respectively, and providing respective electric input signals, c) a signal processing unit comprising c1) a weighting unit for applying weights to the electric input signals, and c2) a hearing loss processing unit providing a processed signal. The hearing device further comprises d) an output unit to provide a stimulus perceivable by the user as sound, e) a feedback detection unit for providing a measure of the current level of feedback from the output to the input, and f) an input signal weight control unit configured to control or influence first and second weights applied to the first and second electric input signals in dependence of the measure of the current level of feedback, and a current level and frequency dependent target gain.

19 Claims, 8 Drawing Sheets

(56) References Cited

U.S. PATENT DOCUMENTS

| | | | | |
|---|---|---|---|---|
| 2014/0348360 | A1 | 11/2014 | Gran | |
| 2016/0173995 | A1* | 6/2016 | Reams | G10L 19/028 381/107 |

FOREIGN PATENT DOCUMENTS

| | | | |
|---|---|---|---|
| EP | 2 849 462 | A1 | 3/2015 |
| EP | 2 947 898 | A1 | 11/2015 |
| WO | WO 2008/151970 | A1 | 12/2008 |

* cited by examiner

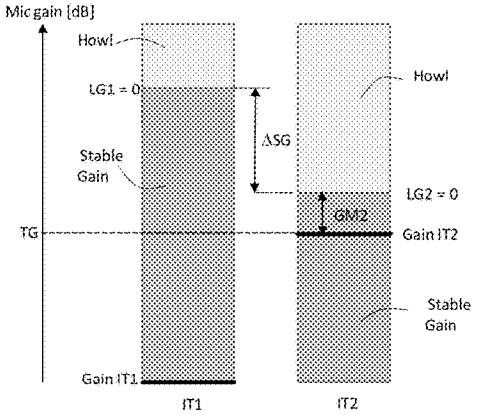
FIG. 4A
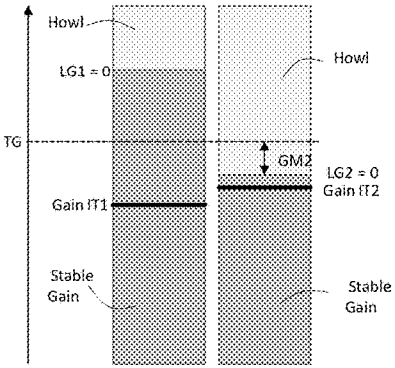
FIG. 4B
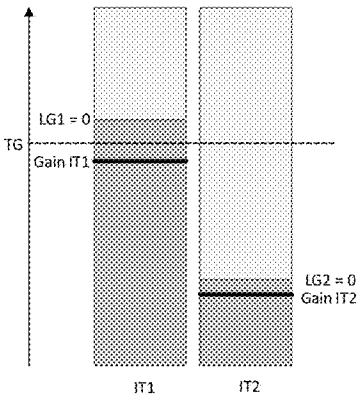
FIG. 4C
FIG. 4D
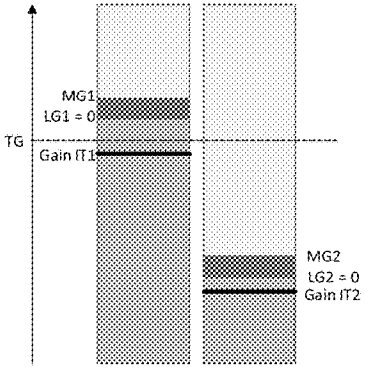
FIG. 4E
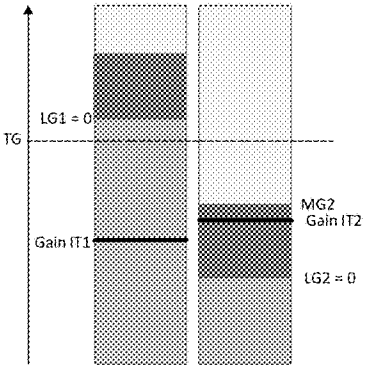
FIG. 4F

HEARING DEVICE COMPRISING A MICROPHONE CONTROL SYSTEM

SUMMARY

The present application relates to hearing devices, e.g. hearing aids. The disclosure relates specifically to a receiver-in-the-ear (RITE) type hearing device comprising an input system (e.g. comprising a microphone system) comprising a multitude (two or more) of input transducers (e.g. microphones), wherein at least a first one of the input transducers (e.g. microphones) is adapted to be located a distance from a second one, e.g. at or behind an ear (pinna) of the user (or elsewhere), and wherein the second one of the input transducers (e.g. microphones) is adapted to be located at or in an ear canal of a user. The present disclosure proposes a scheme for reducing or handling acoustic feedback from a receiver (loudspeaker), e.g. located in the ear canal, to the input system (e.g. a microphone system). An embodiment of the disclosure provides a hearing aid with one or more microphones located at or behind the ear and with one or more microphones and a loudspeaker located at or in the ear canal. In an embodiment, the hearing aid has two microphones, one located at or behind the ear and one located at or in the ear canal. In an embodiment, the hearing aid has three microphones, two located at or behind the ear and one located at or in the ear canal.

Embodiments of the disclosure may e.g. be useful in applications such as hearing aids, in particular hearing aids comprising a second input transducer adapted for being located at or in an ear canal of a user and a (i.e. one or more) first input transducer(s) located elsewhere on the users' body, e.g. in a BTE-part adapted for being located at or behind an ear or the user.

An object of an embodiment of the present application is to reduce (e.g. reduce the effect of) acoustic feedback in a hearing device. In particular, it is an object of embodiments of the disclosure to reduce feedback in so-called open fittings, e.g. in a hearing device comprising a part (here termed the ITE-part) adapted for being located fully or partially in the ear canal of a user, wherein the ITE-part does not provide a seal towards the walls of the ear canal (e.g. in that it exhibits an open structure, such as in that it comprises an open dome structure (or an otherwise open structure with relatively low occlusion effect) to guide the placement of the ITE-part in the ear canal). It is a further object of embodiments of the disclosure to reduce feedback in a hearing device comprising a mould intended to allow a relatively large sound pressure level to be delivered to the ear drum of the user (e.g. a user having a severe-to-profound hearing loss).

According to the present disclosure, a hearing device, e.g. a hearing aid or a headset, is provided. The hearing device comprises a (i.e. at least one) microphone located at or in an ear canal of a user, e.g. in or together with a speaker unit (also located in the ear canal), and a (i.e. at least one) microphone located behind an ear, e.g. in a BTE-part (BTE=behind-the-ear) of the hearing device. Such style (with one microphone at or in an ear canal, and one microphone at or behind an ear) is in the present application termed M2RITE (intended to indicate the presence of 2 microphones ('M2') in a receiver-in-the ear ('RITE') type of hearing device, at acoustically different locations). This results in a relatively large distance of e.g. 35-60 mm between the first and second microphone (cf. e.g. FIG. 5B). This is to be compared to the 7-14 mm distance between microphones of traditional BTE, RITE and ITE (in-the-ear) style hearing devices comprising two microphones located next to each other on/in a housing of a BTE part of the hearing device (cf. e.g. FIG. 5A). This results in a large difference in the acoustical feedback from the speaker in the ear canal to the two individual microphones (cf. IT1, IT2 of FIG. 5B) of the M2RITE type hearing device. In conventional BTE or RITE style hearing devices, the feedback path to the two microphones (cf. ITf, ITr of FIG. 5A) is similar, but in the M2RITE style the feedback to a (first) microphone located in a BTE-part (IT1 in FIG. 5B, relatively far from the speaker) is around 15-25 dB lower than the feedback to the (second) microphone (IT2 in FIG. 5B) located in the ear canal (relatively close to the speaker). In an embodiment, the M2RITE style hearing device (e.g. hearing aid) contains two input transducers (e.g. microphones), one located in or at the ear canal of a user and the other elsewhere on the user, e.g. at the ear of the user (e.g. behind the ear (pinna) of the user), cf. e.g. FIGS. 5B, 5C, and 6. In an embodiment, the hearing device (e.g. of M2RITE style) is configured to provide that the two input transducers are located along a substantially horizontal line when the hearing device is mounted at the ear of the user in a normal, operational state (cf. e.g. input transducers IN1, IN2 and (horizontal, double arrowed, dashed) line OL in FIGS. 5C and 6). This has the advantage of facilitating beamforming of the electric input signals from the input transducers in an appropriate (e.g. horizontal) direction, e.g. the 'look direction' of the user. A further embodiment having two microphones behind the ear, and one microphone at the ear canal is shown in FIG. 5D.

The acoustical feedback to the input transducers (e.g. microphones) located in the ear canal and at or behind the ear from a receiver (loudspeaker) located in the ear canal will be in the (acoustic) near-field range.

Acoustical (or mechanical) feedback in hearing aids may result in unwanted howling or squealing. The feedback is generally cancelled or reduced by a dynamic feedback cancellation (DFC) system (alternatively termed '(adaptive or acoustic) feedback cancellation (or suppression) system' (e.g. abbreviated AFB-system or AFC-system)). The feedback cancellation system attempts to estimate the feedback path and then add a signal in opposite phase to cancel out the feedback (e.g. by subtraction of the feedback estimate signal from the electric input signal).

Alternatively or additionally, feedback reduction systems may act by lowering the gain in the particular in (feedback prone) frequency band(s), if for example the DFC system cannot handle the feedback, or while the DFC system is adapting to a new feedback path, or if no DFC system is available/active. The term 'Feedback Manager' (FBM) is used for a system that lowers the gain, in order to avoid acoustical feedback, e.g. based on a predefined maximum gain to be applied in a given frequency band ($IGmax_{pd}(f)$, such predefined gain being e.g. determined in advance of use of the hearing device. An 'Online Feedback Manager' OFBM refers to a system that—in real time (i.e. during normal use of the hearing device)—adjusts the (maximum) gain to be applied in a given frequency band ($IGmax_{ol}(f)$), if the feedback path is altered, e.g. if a hand or a telephone is held by the ear. Such system is e.g. described in WO2008151970A1.

An undesired side effect of a FBM/OFBM system is that the user does not (always) get the desired amplification of sound.

In general, a hearing device is provided, wherein the first and second input transducers are located on the head of the user to provide (or such that) that a difference in level of feedback from the output transducer to the first and second input transducers is above a predefined minimum level, e.g. above 10 dB, such as above 15 dB, or above 20 dB. In an embodiment, a hearing device, e.g. a hearing aid, according to the present disclosure has at least two input transducers (e.g. microphones) being placed in or around the ear at positions where the acoustical feedback from the ear canal is considerably different at the two microphone positions (e.g. at least 10 dB, such as at least 15 dB, or at least 15 dB, different).

One way of placing the microphones is to locate one microphone in the ear canal, and one microphone behind the ear. In such a configuration, the microphone behind the ear will experience up to 25 dB lower feedback (from a loudspeaker located in the ear canal) than the microphone in the ear canal.

Alternative reasons for these two microphone positions are: A microphone located in the ear canal is ideal for picking up the external sound in a natural manner, which ensures natural localization of sound sources. The two microphones working together can be used for spatial sound processing to emphasize sounds from a particular direction. And the microphone behind the ear alone is good for enabling high gain due to low acoustical feedback.

Usually in a situation where the feedback is stable, a DFC system is good at reducing the feedback. However, as soon as the feedback path is changed, due to a change of the leakage from the loudspeaker to the environment (and thus to the microphone(s)), e.g. due to a user's jaw movements (e.g. chewing) or to a user holding a hand near the ear (e.g. with a telephone), the DFC system needs to adjust to the new situation before the feedback can be correctly reduced again, and this takes a certain time. During this time, the calculated feedback estimate is wrong and cannot correctly out-compensate the feedback gain. A dynamic microphone control scheme for individually controlling the gains (weights) applied to the microphones may advantageously be used to bridge such situations where the feedback path is changing.

In general, a dynamic microphone control scheme as proposed in the present disclosure may be used to control the weights applied to first and second electric input signals from first and second input transducers in dependence of a current gain margin on the first and/or second electric input signals (from first and second input transducers, e.g. microphones), respectively, to thereby minimize a risk of howl (while still providing the requested gain to the user), and to prioritize the (second) electric input signal from the (second) input transducer located at or in the ear canal, when the feedback situation allows. The scheme may be used with or without a feedback cancellation system.

A Hearing Device Comprising a Feedback Detector:

In an aspect of the present application, an object of the application is achieved by a hearing device, e.g. a hearing aid, adapted for being arranged at least partly on a user's head or at least partly implanted in a user's head, the hearing device comprising

- an input unit for providing a multitude of electric input signals representing sound, the input unit comprising
  - a first input transducer for picking up a sound signal from the environment and providing a first electric input signal, the first input transducer being located on the head, e.g. at or behind an ear, of the user;
  - a second input transducer for picking up a sound signal from the environment and providing a second electric input signal, the second input transducer being located at or in an ear canal of the user,
- a signal processing unit providing a processed signal based on one or more of said first and second electric input signals, the signal processing unit comprising
  - a weighting unit, e.g. a beamformer unit, for providing a weighted, e.g. beamformed, signal by applying respective first and second weights to the first and second electric input signals and combining the weighted first and second electric input signals or signals derived therefrom to the weighted, e.g. beamformed, signal, and
  - a hearing loss processing unit coupled to the weighting unit, e.g. beamformer unit, and providing the processed signal, wherein the hearing loss processing unit is configured to determine a current level and frequency dependent target gain, e.g. to compensate for a user's hearing impairment, and
- an output unit comprising an output transducer for converting said processed signal or a signal originating therefrom to a stimulus perceivable by said user as sound.

The hearing device further comprises

- a feedback detection unit for providing a measure, termed the feedback measure, of the current level of feedback from the output transducer to the first and/or second input transducer or a difference there between; and
- an input signal weight control unit configured to control or influence the first and second weights applied to the first and second electric input signals in dependence of said measure of the current level of feedback, and said current level and frequency dependent target gain.

This has the advantage of providing a robust handling of feedback in a hearing device comprising an input transducer in or at the ear canal.

The measure of current feedback (e.g. its level) from the output transducer to the second input transducer is termed the feedback measure.

In an embodiment, the feedback measure is implemented as a binary value (e.g. 0 or 1). In an embodiment, the feedback measure is implemented as a relative measure (e.g. between 0 and 1).

In an embodiment, the feedback measure is used to control a feedback cancellation system, and/or an amplification system of the hearing device.

In the present application the term 'feedback detection unit' is used for a device that provides a measure of a current feedback (e.g. its (possibly broadband or frequency dependent) level) from the output transducer to the first and/or second input transducer (or a difference there between). In an embodiment, the 'feedback detection unit' form part of a feedback cancellation system (so that the feedback measure is provided by a feedback estimation unit (e.g. an adaptive filter) of the feedback cancellation system). In an embodiment, the 'feedback detection unit' is a separate unit in addition to a feedback cancellation system. In an embodiment, the 'feedback detection unit' and a feedback estimation unit of a feedback cancellation system both provide inputs to the input signal weight control unit for determining appropriate first and second weights. In an embodiment, the 'feedback detection unit' is a separate unit that alone is responsible for the feedback input to the input signal weight control unit (e.g. where no feedback cancellation system is present or active). In an embodiment, the feedback detection unit is configured to provide an estimate of the current feedback path from the from the output transducer to the first and/or second input transducers (e.g. its impulse response or its frequency response).

In an embodiment, the attenuation of the acoustic propagation path of sound from the second to the first input transducer is determined for an acoustic source in the near-field, e.g. from the output transducer of the hearing device as reflected by the ear drum and leaked through the ear canal to the second input transducer. In an embodiment, the propagation distance between the output transducer (or the outlet from the output transducer) and the second input transducer is less than 0.05 m, such as less than 0.03 m, e.g. less than 0.02 m, such as less than 0.015 m. In an embodiment, the propagation distance between the second input transducer and the first input transducer is less than 0.3 m, such as less than 0.1 m, such as less than 0.08 m, e.g. less than 0.06 m, e.g. in the range between 0.02 and 0.1 m, e.g. in the range between 0.02 and 0.06 m. In an embodiment, the propagation distance between the second input transducer and the first input transducer is larger than 0.02 m, such as larger than 0.05 m, such as larger than 0.08 m, such as larger than 0.1 m, such as larger than 0.2 m.

In an embodiment, the weighting unit, e.g. beamformer unit, is adapted to provide a weighted combination of a multitude M of electric input signals, where M is larger than two. In an embodiment, the weighting unit provides a signal that is a linear combination of the M electric input signals $IN_i$ (i=1, . . . , M): $IN_1(k,m)*w_1(k,m)+ \ldots +IN_M(k,m)*w_M(k,m)$, where $w_i$. i=1, . . . , M, and M is the number of electric input signals ($IN_i$), and where k and m are frequency and time indices, respectively. The weights $w_i$ are real or complex (and in general, time and frequency dependent).

The weighting unit may implement a selector (in which case the weights $w_i$ are binary, one of the weights being equal to is 1, and the others being equal to 0), or a mixer (in which case the weights $w_i$ are real and the sum of the weights is 1), or a beamformer unit (in which case the weights $w_i$ are generally complex).

In the present application, the term 'weighting unit' (providing a weighted signal) and 'beamformer unit' (providing a beamformed signal) is used interchangeably with no intended difference in meaning.

In an embodiment, one or more of the weights is/are complex. In an embodiment, one or more weights $w_i$ of the weighted combination of the multitude of electric input signals $IN_i$ or signals derived therefrom is/are changed in dependence of the feedback measure.

In an embodiment, the weights are changed to change an emphasis of the weighting, e.g. beamformer, unit from one electric input signal to another in dependence of the feedback measure. In an embodiment, the weights of the weighting, e.g. beamformer, unit are configured to emphasize the second electric input signal in case the feedback detector indicates that the current acoustic situation is NOT dominated by feedback. In an embodiment, the hearing device is configured to change the weights of the weighting, e.g. beamformer, unit to emphasize the first electric input signal in the weighted, e.g. beamformed, signal in case the feedback detector indicates that the current acoustic situation is dominated by feedback. In an embodiment, the hearing device is configured to change the weights of the weighting, e.g. beamformer, unit from emphasizing the first electric input signal towards emphasizing the second electric input signal in the weighted, e.g. beamformed, signal in case the feedback detector changes its indication of the acoustic situation from being dominated by feedback to NOT being dominated by feedback (or vice versa).

In an embodiment, the hearing device is configured to control the beamformer unit to increase the weight of the first electric signal in the beamformed signal in case the feedback difference indicates that the current acoustic situation is dominated by feedback (e.g. determined per frequency band). In an embodiment, the hearing device is configured to control the beamformer unit to increase (or decrease) the weight of the first electric signal in the beamformed signal (e.g. in frequency bands) where the feedback difference indicates that the current acoustic situation is (or is NOT) dominated by feedback. In an embodiment, the hearing device is configured to control the beamformer unit to decrease (or increase) the weight of the second electric signal in the beamformed signal (e.g. in frequency bands) in case the feedback difference indicates that the current acoustic situation is (or is NOT) dominated by feedback. In an embodiment, the hearing device is configured to control the beamformer unit to increase the weight of the first electric signal in the beamformed signal and to decrease the weight of the second electric signal in the beamformed signal in case the feedback difference indicates that the current acoustic situation is dominated by feedback (e.g. determined per frequency band). In an embodiment, the hearing device is configured to control the weighting unit (e.g. a mixer or a beamformer unit) to decrease the weight of the first electric signal(s) and/or to increase the weight of the second electric signal in the mixed or beamformed signal in frequency bands where the feedback difference indicates that the current acoustic situation is NOT dominated by feedback.

In an embodiment, the hearing device comprises a forward or signal path between the input unit (e.g. comprising first and second microphones, and/or direct electric input (e.g. a wireless receiver)) and the output unit. In an embodiment, the signal processing unit is located in the forward path between the input and output units. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the signal processing unit is configured to take other measures than control of the beamformer unit in case of an indication by the feedback detector that the current acoustic situation is dominated by feedback. In an embodiment, such other measures may include changing a parameter of the feedback cancellation system, e.g. changing an adaptation rate of the adaptive algorithm and/or the application of a de-correlation (e.g. a frequency shift) to a signal of the forward path.

In an embodiment, the following priority scheme is aimed at (P1, P2, P3, P4, P1 and P4 having the highest and lowest priority, respectively), e.g. prioritized on a frequency band level:

P1: Minimize howl and/or artifacts.

P2: Apply gain as prescribed (apply target gain)

P3: Use natural pinna effect as much as possible (by having emphasis on the second input transducer located at or in the ear canal). Increase SNR as much as possible (for the second electric signal).

P4: Reduce microphone noise as much as possible.

The first and second input transducers are intended to be located at the same ear of the user. In an embodiment, the first and second input transducers comprises first and second microphones, respectively.

In an embodiment, the hearing device comprises a BTE-part adapted to be worn at or behind an ear of a user, and an ITE-part adapted to be located at or in an ear canal of the user. In an embodiment, the first input transducer is located in the BTE-part. In an embodiment, the second input transducer is located in the ITE-part.

In an embodiment, the first input transducer is located in the BTE-part, and the second input transducer is located in the ITE-part. In an embodiment, the BTE-part comprises more than one input transducer, e.g. two input transducers located in the BTE-part to contribute to a directional system for signals from an acoustic far-field. In an embodiment, the ITE-part comprises more than on input transducer, e.g. a microphone, located so that it picks up sound from a volume of the ear canal between the ITE-part and an ear drum, when mounted in the ear canal of the user.

In an embodiment, the hearing device comprises a time to time-frequency conversion unit allowing the processing of signals in the (time-)frequency domain. In an embodiment, the comparison unit is configured to process the first and second electric input signal in a number of frequency bands. In an embodiment, the comparison unit is configured to only compare selected frequency bands, e.g. in correspondence with an acoustic transfer function from the second input transducer to the first input transducer. In an embodiment, the selected frequency bands are frequency bands that are estimated to be at risk of containing significant feedback, e.g. at risk of generating howl. In an embodiment, the selected frequency bands are predefined, e.g. determined in an adaptation procedure (e.g. a fitting session). In an embodiment, the selected frequency bands are dynamically determined, e.g. using a learning procedure (e.g. starting by considering all bands, and then limiting the comparison to bands where a significant level difference (e.g. above a predefined threshold level) is experienced over a predefined time period).

In an embodiment, the input unit, and or a transceiver unit comprise(s) the time to time-frequency conversion (TF-conversion) unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of (e.g. uniform) frequency bands, where NI is e.g. larger than 5, such as larger than 10, such as larger than 50, such as larger than 100, such as larger than 500. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, signal processing in the signal processing unit and/or in the feedback detection unit and/or in the input signal weight control unit is performed in the time domain (on a broad band signal). In an embodiment, signal processing in the signal processing unit and/or in the feedback detection unit and/or in the input signal weight control unit is performed in the time-frequency domain (in a number of frequency bands). In an embodiment, the signal processing in the signal processing unit is performed in the time-frequency domain, whereas the signal processing in the feedback detection unit and/or in the input signal weight control unit is performed in the time domain (or in a smaller number of bands than in the signal processing unit). In an embodiment, the signal processing in the signal processing unit is performed in the time domain, whereas the signal processing in the feedback detection unit and/or in the input signal weight control unit is performed in the time-frequency domain.

In an embodiment, the weight control unit is configured to provide the first and second weights in a number of frequency bands. In an embodiment, the feedback measure is provided in a number of frequency bands.

In an embodiment, the input signal weight control unit configured to control or influence the first and second weights applied to the first and second electric input signals in dependence of a predefined maximum gain to be applied in a given frequency band, such predefined maximum gain being either determined in advance of use or dynamically during use of the hearing device.

In an embodiment, the feedback detection unit comprises

- a first signal strength detector for providing a signal strength estimate of the first electric input signal, and
- a second signal strength detector for providing a signal strength estimate of the second electric input signal,
- a comparison unit coupled to the first and second signal strength detectors and configured to compare the signal strength estimates of the first and second electric input signals and to provide a signal strength comparison measure indicative of the difference between said signal strength estimates;
- a decision unit for providing the feedback measure indicative of current acoustic feedback, e.g. a level, from said output transducer to said first and/or second input transducer based on said signal strength comparison measure.

The term 'signal strength' is taken to include one or more of signal level, signal power, and signal energy. In an embodiment, the signal strength detector comprises a level detector or a power spectrum detector. In an embodiment, 'signal strength' (e.g. at a specific frequency or range) refers to power spectrum density (e.g. at a specific frequency or range).

In an embodiment, the feedback detection unit is configured to provide an estimated level of current acoustic feedback. In an embodiment, the feedback measure indicative of current acoustic feedback is provided as a probability that the first and/or second electric input signal(s) is/are dominated by acoustic feedback (e.g. in a number of frequency bands).

In an embodiment, the hearing device comprises a feedback cancellation system for reducing the acoustic or mechanical feedback from the output transducer to the first and/or second input transducer. In an embodiment, the feedback cancellation system comprises an adaptive filter.

Adaptive feedback cancellation has the ability to track feedback path changes over time. It is e.g. based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the feedback measure indicative of the amount of acoustic feedback is used to control the feedback cancellation system. In an embodiment, the hearing device is configured to control an adaptation rate of an adaptive algorithm of the feedback cancellation system depending on the feedback measure. In an embodiment, the hearing device comprises a de-correlation unit for increasing a de-correlation between an output signal from the hearing device and an input signal to the hearing device (e.g. by introducing a small frequency shift, e.g. <20 Hz in the forward path of the hearing device). In an embodiment, the hearing device is configured to control the de-correlation unit (e.g. its activation or de-activation and/or the size of the frequency shift) depending on the feedback measure.

In an embodiment, the hearing device, e.g. the feedback cancellation system, is configured to estimate a current feedback path from the output transducer to the first and/or second input transducer and to subtract said estimate of the current feedback path from the respective first and/or second electric input signals to provide respective feedback corrected electric input signals. In an embodiment, the feedback detector is configured to determine when the current level, and/or a change of the current level and/or a rate of change of the current level of feedback is above respective predefined feedback and feedback change threshold values, and to provide a feedback change measure indicative thereof (e.g. forming part of being supplement to the feedback measure). In an embodiment, the hearing device, e.g. the feedback cancellation system, is configured to provide that an update of said estimate of the current feedback path is disabled (and/or enabled, respectively) in dependence of the feedback change measure (i.e. when the current level, and/or a change of the current level and/or a rate of change of the current level of feedback is above (or below, respectively) said respective predefined feedback and feedback change threshold values).

In an embodiment, the weighting or beamformer unit comprises first, far-field adjustment units configured to compensate the electric input signals for the different location relative to an acoustic source from the far field, whereby a maximum directional sensitivity of the weighted or beamformed signal may be provided in a direction of a target signal from the environment. In an embodiment, the weighting or beamformer unit comprises second, near-field adjustment units to compensate the electric input signals for the different location relative to an acoustic source from the near-field, whereby a minimum directional sensitivity of the weighted or beamformed signal may be provided in a direction of the output transducer.

In an embodiment, the weight control unit is configured to determine the first and second weights w1, w2 on the basis of the feedback measure from the feedback detection unit, and on a target gain requested by the hearing loss processing unit.

In an embodiment, the input signal weight control unit is configured to control the first and second weights to avoid howl while providing the current level and frequency dependent target gain.

In an embodiment, the signal strength is taken to mean the magnitude (level) of the signal. In an embodiment, the decision unit is configured to apply a feedback difference threshold to make a binary distinction between a feedback dominant and non-feedback dominant acoustic situation. In an embodiment, a condition for concluding that a current acoustic situation is dominated by acoustic feedback is determined by the signal strength (e.g. the level or power or energy) of the second electric input signal being larger than the signal strength (e.g. the level or power or energy) of the first electric input signal AND the signal strength comparison measure indicative of the difference between the signal strength estimates being indicative of the difference being larger than the feedback difference threshold. In an embodiment, the feedback difference threshold is frequency dependent. In an embodiment, the feedback difference threshold is different in different frequency bands. The feedback difference threshold is preferably adapted in dependence on whether the signal strength is a level, a power or an energy. In an embodiment the feedback difference threshold is a threshold for the difference between the levels of the second and first electric input signals that discriminates between an acoustic situation with feedback (dominant feedback) and an acoustic situation with no feedback (not dominant feedback). In an embodiment, the decision unit is configured to apply a feedback difference threshold to make a binary distinction between a feedback dominant and non-feedback dominant acoustic situation.

In an embodiment, the feedback difference threshold is predetermined. In an embodiment, the feedback threshold is determined during a fitting session, e.g. prior to the normal use of the hearing device. In an embodiment, the transfer function (e.g. the attenuation) of a sound source from the ear canal (e.g. the output transducer of the hearing device) from the second input transducer to the first input transducer is determined in an off-line procedure, e.g. during fitting of the hearing device to the specific user. In an embodiment, the transfer function from the second input transducer to the first input transducer is estimated in advance of the use of the hearing device, e.g. using an 'average head model', such as a head-and-torso simulator (e.g. Head and Torso Simulator (HATS) 4128C from Brüel & Kjær Sound & Vibration Measurement A/S). In an embodiment, the transfer function from the second input transducer to the first input transducer is dynamically estimated. In an embodiment, the feedback difference threshold is between 5 dB and 25 dB. In an embodiment, the feedback difference threshold is adapted to represent a level difference between the first and second electric input signals. In an embodiment, the feedback difference threshold is between 15 dB and 25 dB. In an embodiment, the feedback difference threshold is larger than 15 dB, e.g. around 20 dB.

In an embodiment, the hearing device is configured to control a beamformer unit, a feedback cancellation system and/or a gain control unit according to a predefined criterion involving the feedback measure. In an embodiment, the predefined criterion involving the feedback measure comprises a lookup table of actions relating ranges of values of the feedback measure to actions related to the beamformer unit, the feedback cancellation system and the gain control unit.

In an embodiment, the hearing device comprises a hearing aid, a headset, an active ear protection device or a combination thereof. In an embodiment, the hearing device comprises a hearing aid, e.g. a hearing instrument, e.g. a hearing instrument adapted for being located at the ear or fully or partially in the ear canal of a user, and/or fully a hearing instrument comprising an implanted part (e.g. an electrode and associated mechanical and electronic parts of a cochlear implant type hearing aid or a fastening element for securing a vibrator of a bone anchored hearing aid to the head of the user)

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the output unit is configured to provide a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input unit comprises a wireless receiver for receiving a wireless signal comprising sound and for providing an electric input signal representing said sound. In an embodiment, the beamformer unit is adapted to enhance a target acoustic source among a multitude of acoustic sources in the local environment of the user wearing the hearing device. In an embodiment, the beamformer unit system is adapted to detect (such as adaptively detect) a direction to (at least) a particular one of the acoustic sources (e.g. a target source).

In an embodiment, the hearing device comprises an antenna and transceiver circuitry for wirelessly receiving a direct electric input signal from another device, e.g. a communication device or another hearing device.

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time t (or n), each audio sample representing the value of the acoustic signal at $t_n$ by a predefined number $N_b$ of bits, $N_b$ being e.g. in the range from 1 to 48 bits, e.g. 24 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples (e.g. corresponding to a frame length of 3.2 ms). Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, feedback, etc.), and c) the current mode or state of the user (movement, temperature, etc.);

d) the current mode or state of the hearing device (program selected, time elapsed since last user interaction, etc.) and/or of another device in communication with the hearing device.

In an embodiment, the hearing device further comprises other relevant functionality for the application in question, e.g. compression, noise reduction, etc.

Use:

In an aspect, use of a hearing device as described above, in the 'detailed description of embodiments' and in the claims, is moreover provided. In an embodiment, use is provided in a system or device comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

Definitions

The 'near-field' of an acoustic source is a region close to the source where the sound pressure and acoustic particle velocity are not in phase (wave fronts are not parallel). In the near-field, acoustic intensity can vary greatly with distance (compared to the acoustic far-field). The near-field is generally taken to be limited to a distance from the source equal to about a wavelength of sound. The wavelength $\lambda$ of sound is given by $\lambda=c/f$, where c is the speed of sound in air (343 m/s, @ 20° C.) and f is frequency. At f=1 kHz, e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element)

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output unit for providing an audible signal to the user in dependence on the processed audio signal. The signal processing unit may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain may be determined in a fitting process by a fitting system based on a user's hearing data, e.g. an audiogram, using a fitting rationale. The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
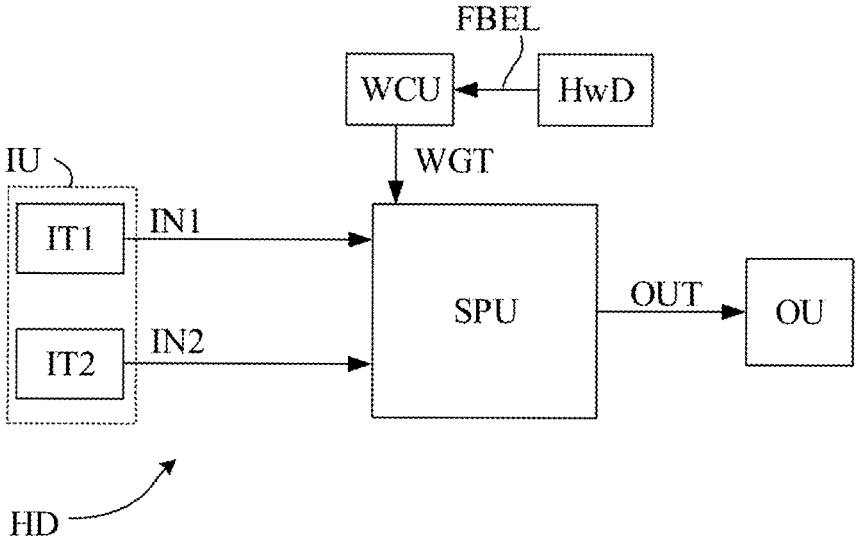
FIG. 1A shows a first embodiment of a hearing device comprising a feedback detection unit and a weight control unit according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

It is a general known problem for hearing aid users that acoustical feedback from the ear canal causes the hearing aid to whistle if the gain is too high and/or if the vent opening in the ear mould is too large. The more gain that is needed to compensate for the hearing loss, the smaller the vent (or effective vent area) must be to avoid whistle, and for severe hearing losses even the leakage between the ear mould (without any deliberate vent) and the ear canal can cause the whistling.

Hearing aids with microphones behind the ear can achieve the highest gain, due to their relatively large distance from the ear canal and vent in the mould. But for users with severe hearing loss needing high gain, it can be difficult to achieve a sufficient venting in the mould (with an acceptable howl risk).

An anti-feedback system may be designed to cancel out or attenuate the acoustical feedback. Such anti-feedback system (or 'feedback cancellation system') usually comprises some sort of howl- or tone-detection, and may act by suppressing the gain in case of a howl detection. Sometimes external sound are falsely identified as feedback howl, and then unintendedly suppressed. This may e.g. occur in the case of music (and be annoying to a listener).

EP2843971A1 deals with a hearing aid device comprising an "open fitting" providing ventilation, a receiver arranged in the ear canal, a directional microphone system comprising two microphones arranged in the ear canal at the same side of the receiver, and means for counteracting acoustic feedback on the basis of sound signals detected by the two microphones. An improved feedback reduction can thereby be achieved, while allowing a relatively large gain to be applied to the incoming signal.

EP2947898A1 deals with a hearing device comprising first and second input transducers located behind the ear and in the ear canal, respectively, and an output transducer located in the ear canal, and a processing unit for processing first and second electric signals from the first and second input transducers including to determine their respective levels and a level difference between them, and to provide an output signal in dependence of the first and/or second electric signals and their level difference.

FIG. 1A-1D shows four embodiments of a hearing device (HD) according to the present disclosure. Each of the embodiments of a hearing device (HD) comprises an input unit (IU; IUa, IUb) for providing a multitude (at least two) of electric input signals representing sound. The input unit comprises a first input transducer (IT1), e.g. a first microphone, for picking up a sound signal from the environment and providing a first electric input signal (IN1), and a second input transducer (IT2), e.g. a second microphone, for picking up a sound signal from the environment and providing a second electric input signal (IN2). The first input transducer (IT1) is e.g. adapted for being located behind an ear of a user (e.g. behind pinna, such as between pinna and the skull). The second input transducer (IT2) is adapted for being located in an ear of a user, e.g. near the entrance of an ear canal (e.g. at or in the ear canal or outside the ear canal but in the concha part of pinna). In an embodiment, the hearing device may comprise two 'first' input transducers, e.g. microphones, adapted for being located behind an ear of a user (cf. $IT_{11}$, $IT_{12}$ in FIG. 6B). The hearing device (HD) further comprises a signal processing unit (SPU) for providing a processed signal (OUT) based (at least) on the first and/or second electric input signals (IN1, IN2). The signal processing unit (SPU) may be located in a body-worn part (BW) e.g. located at an ear, but may alternatively be located elsewhere, e.g. in another hearing device, in an audio gateway device, in a remote control device, or in a SmartPhone. The hearing device (HD) further comprises an output unit (OU) comprising an output transducer (OT), e.g. a loudspeaker, for converting the processed signal (OUT) or a further processed version thereof to a stimulus perceivable by the user as sound. The output transducer (OT) is e.g.

located in an in-the-ear part (ITE, cf. FIG. 1C, 1D) of the hearing device adapted for being located in the ear of a user, e.g. in the ear canal of the user, e.g. as is customary in a RITE-type hearing device. The signal processing unit (SPU) is located in the forward path between the input and output units (here coupled to the input transducers (IT1, IT2) and to the output transducer (OT)). The signal processing unit (SPU) comprises a beamformer unit for providing a beamformed signal by applying first and second (real or complex, e.g. time and/or frequency dependent) weights (w1, w2 in FIG. 3 and FIG. 7B) to the first and second electric input signals (IN1, IN2) and combining the weighted first and second electric input signals or signals derived therefrom to a beamformed signal (BFS, cf. FIGS. 3 and 7B). The signal processing unit (SPU) further comprises a hearing loss processing unit (G in FIG. 3 and FIG. 7B) coupled to the beamformer unit and providing the processed signal (OUT), wherein the hearing loss processing unit (G) is configured to determine a current level and frequency dependent target gain, e.g. to compensate for a user's hearing impairment. The hearing device (HD) further comprises a feedback detection unit or howl detector (HwD) for providing a feedback measure (FBEL). The feedback measure may e.g. give a binary indication of the current acoustic environment of the hearing devices as 'dominated by acoustic feedback' or as 'not dominated by acoustic feedback'. Alternatively, the feedback measure may be indicative of the amount of acoustic feedback from the output transducer to the first and/or second input transducer. The feedback measure (FBEL) may be frequency dependent. The hearing device (HD) further comprises an input signal weight control unit (WCU) configured to control or influence first and second weights WGT (w1, w2 in FIGS. 3 and 7B) applied to the first and second electric input signals (IN1, IN2) in dependence of the measure of the current level of feedback (FBEL), and the current level and frequency dependent target gain.

A first aim of the location of the first and second input transducers is to allow them to pick up sound signals in the acoustic near-field leaking from the output transducer (OT), e.g. as reflected sound from the ear drum. A further aim of the location of the second input transducer is to allow it to pick up (acoustic far-field) sound signals that include the cues resulting from the function of pinna (e.g. directional cues) from sound sources more than 0.5 m away from the second input transducer (e.g. more than 1 m or 2 m away).

The embodiments of FIG. 1A-1D all show two input transducers (IT1, IT2). The number of input transducers coupled to the signal processing unit (SPU) may, however, be larger than two (IT1, . . . , ITn, n being any size (e.g. 3 or more) that makes sense from a signal processing point of view), and may include input transducers of a mobile device, e.g. a SmartPhone or even fixedly installed input transducers (e.g. in a specific location, e.g. in a room) in communication with the signal processing unit.

Each of the input transducers of the input unit (IU; IUa, IUb) can theoretically be of any kind, such as comprising a microphone (e.g. a normal microphone or a vibration sensing bone conduction microphone), or an accelerometer, or a wireless receiver. The embodiments of a hearing device (HD) of FIGS. 1C and 1D each comprises two input transducers (IT1, IT2) in the form of microphones (e.g. omni-directional microphones).

Each of the embodiments of a hearing device (HD) comprises an output unit (OU) comprising an output transducer (OT) for converting a processed output signal to a stimulus perceivable by the user as sound. In the embodiments of a hearing device (HD) of FIGS. 1C and 1D, the output transducer is shown as receivers (loudspeakers). A receiver can e.g. be located in an ear canal (RITE-type (Receiver-In-The-ear) or a CIC (completely in the ear canal-type) hearing device) or outside the ear canal (e.g. a BTE-type hearing device), e.g. coupled to a sound propagating element (e.g. a tube) for guiding the output sound from the receiver to the ear canal of the user (e.g. via an ear mould located at or in the ear canal). Alternatively, other output transducers can be envisioned, e.g. a vibrator of a bond conducting, e.g. bone anchored hearing device.

The 'operational connections' between the functional elements signal processing unit (SPU), input transducers (IT1, IT2), and output transducer (OT)) of the hearing device (HD) can be implemented in any appropriate way allowing signals to the transferred (possibly exchanged) between the elements (at least to enable a forward path from the input transducers to the output transducer, via (and possibly in control of) the signal processing unit). The solid lines (e.g. those denoted IN1, IN2, OUT) generally represent wired electric connections. The dashed zig-zag line (denoted WL in FIG. 1D) represent a non-wired electric connections, e.g. a wireless connection, e.g. based on electromagnetic signals, in which case the inclusion of relevant antenna and transceiver circuitry (Tx/Rx, Rx/Tx) is implied). In other embodiments, one or more of the wired connections of the embodiments of FIG. 1A to 1D may be substituted by wireless connections using appropriate transceiver circuitry, e.g. to provide partition of the hearing device or system optimized to a particular application. One or more of the wireless links may be based on Bluetooth technology (e.g. Bluetooth Low-Energy or similar technology). Thereby a large bandwidth and a relatively large transmission range is provided. Alternatively or additionally, one or more of the wireless links may be based on near-field, e.g. capacitive or inductive, communication. The latter has the advantage of having a low power consumption (at the cost of a smaller transmission range).

The signal processing unit (SPU) may comprise a number of processing algorithms, e.g. a noise reduction algorithm, for enhancing the (possibly spatially filtered) beamformed signal according to a user's needs to provide the processed output signal (OUT). The signal processing unit (SPU) may e.g. comprise a feedback cancellation system (e.g. comprising one or more adaptive filters for estimating a feedback path from the output transducer to one or more of the input transducers, cf. e.g. FIGS. 2A, 2B and 3). In an embodiment, the feedback cancellation system may be configured to use the feedback measure (FBEL) to activate a particular FEEDBACK mode where feedback above a predefined level is detected (e.g. in a particular frequency band or overall). In the FEEDBACK mode, the feedback cancellation system is used to update estimates of the respective feedback path(s) and to subtract such estimate(s) from the respective input signal(s) (IN1, IN2) (cf. FIG. 2A) or the beamformed signal (BFS) (cf. FIG. 2B) to thereby reduce (or cancel) the feedback contribution in the input signal(s). The feedback measure (FBEL) may e.g. be used to control or influence an adaptation rate of an adaptive algorithm of the feedback cancellation system. The feedback measure (FBEL) may e.g. be used to control or influence a de-correlation unit of the forward path, e.g. a frequency shift (on-off, or amount of frequency shift). The update of the estimates of the respective feedback path(s) are preferably disabled, when the feedback path is changing (as indicated by the feedback measure or a specific feedback change measure). Update of the feedback path(s) is preferably resumed, when the feedback path is indicated to be stable (e.g. as indicated by the feedback measure or a specific feedback change measure).

All embodiments of a hearing device are adapted for being arranged at least partly on a user's head or at least partly implanted in a user's head.

Figure 1B:
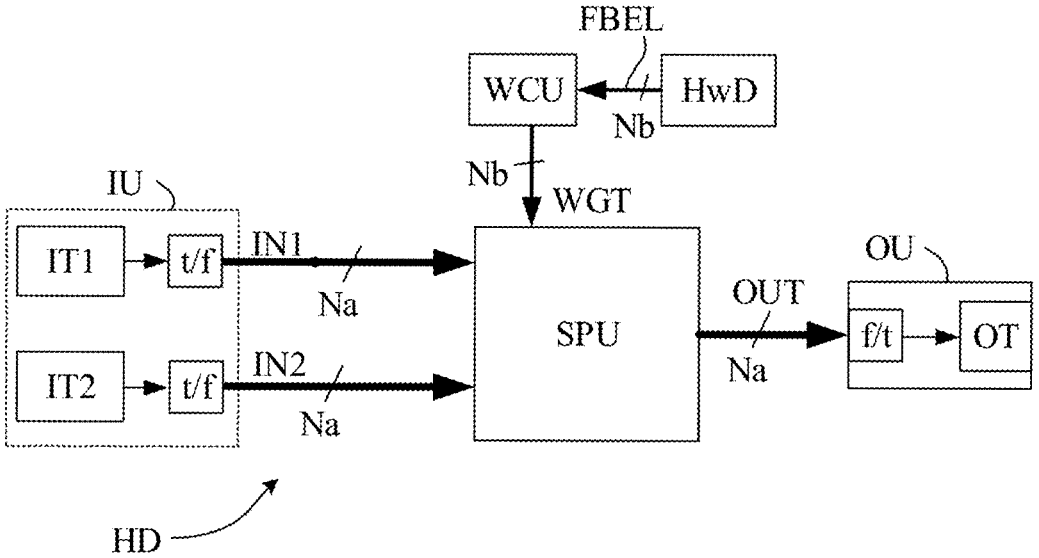
FIG. 1B shows a second embodiment of a hearing device according to the present disclosure.
Figure 1C:
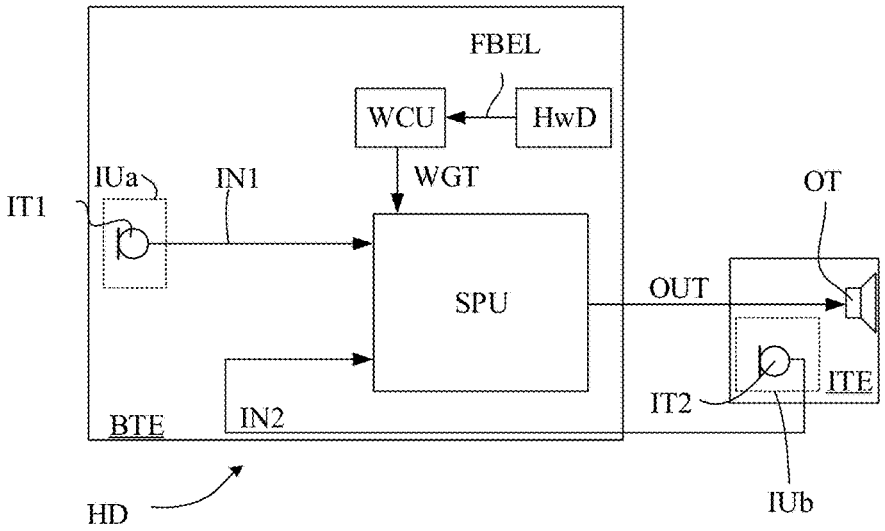
FIG. 1C shows a third embodiment of a hearing device according to the present disclosure.
Figure 1D:
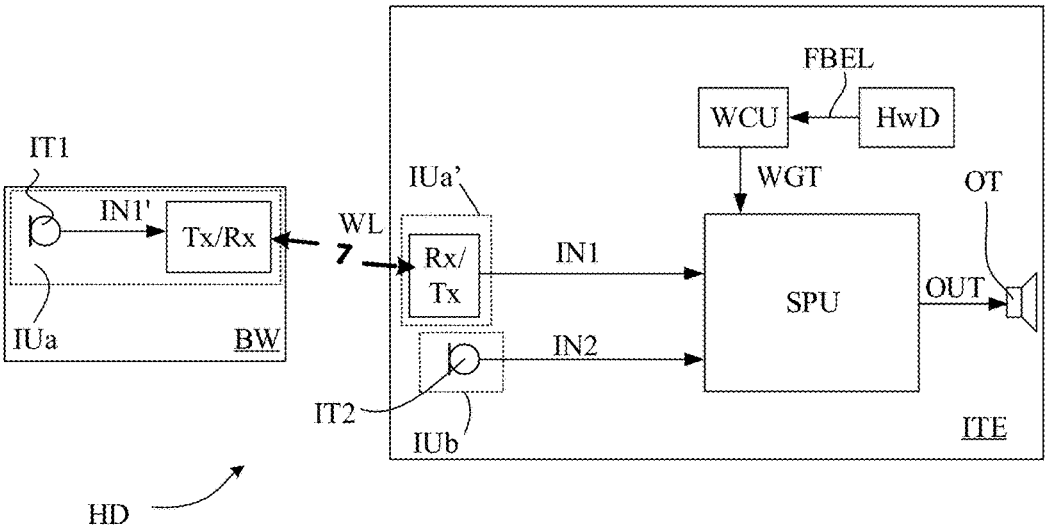
FIG. 1D shows a fourth embodiment of a hearing device according to the present disclosure.

FIG. 1A shows a hearing device according to the present disclosure in its most general form as discussed above and comprising a forward path comprising an input unit (IU) comprising two input transducers (IT1, IT2) coupled to a signal processing unit (SPU) coupled to an output unit (OU). The hearing device (HD) further comprises feedback detection unit (HwD) coupled (via signal FBEL providing a measure of the current level of feedback) to input signal weight control unit (WCU) providing weights WGT to the signal processing unit (SPU) to be applied to electric input signals IN1, IN2. The embodiments shown in the FIGS. 1C and 1D are intended to illustrate different partitions of the hearing device of FIG. 1A, 1B. The following brief discussion of FIG. 1B to 1D is focused on the differences to the embodiment of FIG. 1A. Otherwise, reference is made to the above general description.

FIG. 1B shows an embodiment of a hearing device (HD) as shown in FIG. 1A, but including time-frequency conversion units (t/f) enabling analysis and/or processing of the electric input signals (IN1, IN2) from the input transducers (IT1, IT2, e.g. microphones), respectively, in the frequency domain. The time-frequency conversion units (t/f) are shown to be included in the input unit (IU), but may alternatively form part of the respective input transducers or of the signal processing unit (SPU) or be separate units. The hearing device (HD) further comprises a time-frequency to time conversion unit (f/t), shown to be included in the signal processing output unit (OU). Such functionality may alternatively be located elsewhere, e.g. in connection with the signal processing unit (SPU) or the output transducer (OT). The signals (IN1, IN2, OUT) of the forward path between the input and output units (IU, OU) are shown as bold lines and indicated to comprise Na (e.g. 16 or 64 or more) frequency bands (of uniform or different frequency width). The signals (FBEL, WGT) of the analysis path are shown as semi-bold lines and indicated to comprise Nb (e.g. 4 or 16 or more) frequency bands (of uniform or different frequency width). Na and Nb may be equal or different according to system requirements (e.g. power consumption, necessary accuracy, etc.).

Figure 6A:
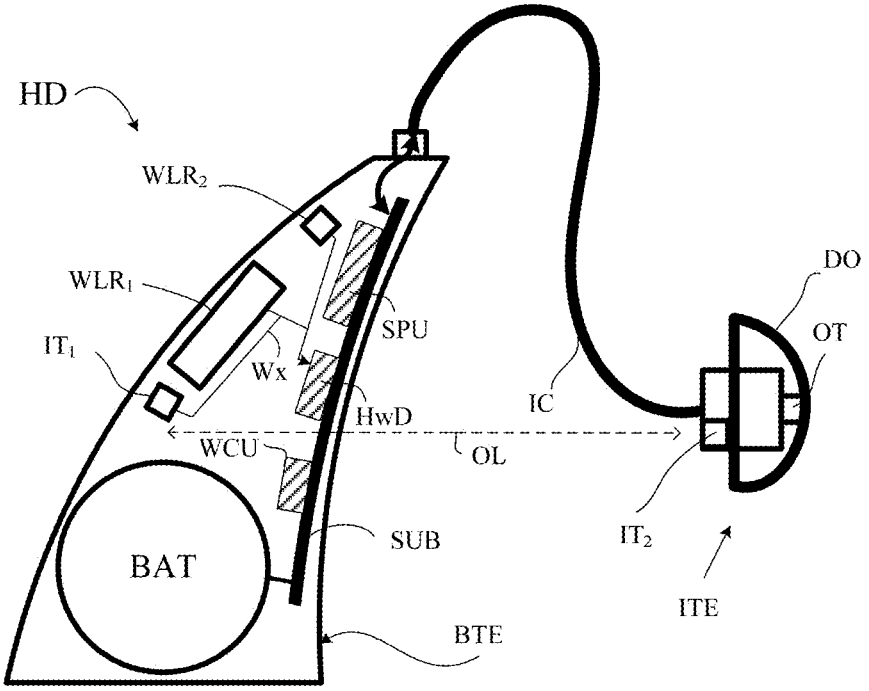
FIG. 6A shows an embodiment of a first M2RITE style hearing device according to the present disclosure.
Figure 6B:
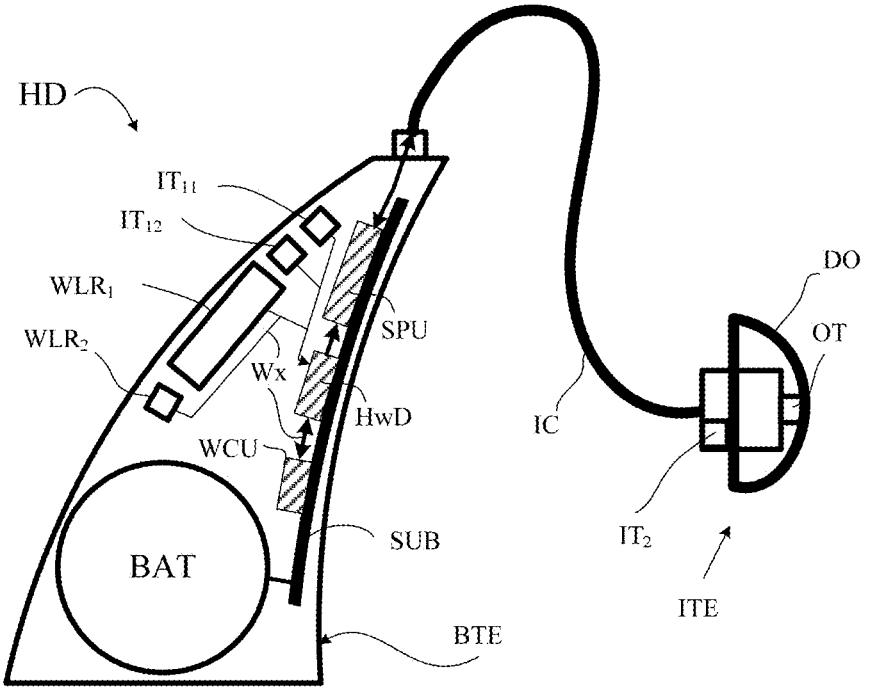
FIG. 6B shows a second embodiment of a hearing device according to the present disclosure, FIG. 7A schematically illustrates the use of the feedback measure to determine an appropriate weighting of electric input signals in a number frequency bands.

FIG. 1C shows an embodiment of a hearing device (HD) as shown in FIG. 1A or 1B, but the feedback detection unit (howl detector, HwD), the weight control unit (WCU), and the signal processing unit (SPU) are located in a behind-the-ear part (BTE) together with one or more input transducers (microphones IT1, as shown in FIG. 1C, or e.g. IT11, IT12, as shown in FIG. 6B) forming part of input unit part IUa). The second input transducer (microphone IT2 forming part of input unit part IUb) is located in an in-the-ear part (ITE) together with the output transducer (loudspeaker OT forming part of output unit OU). The BTE and ITE parts are electrically connected by an electric cable comprising two or more electric conductors (e.g. wires).

FIG. 1D illustrates an embodiment of a hearing device (HD), wherein the feedback detection unit (howl detector, HwD), the weight control unit (WCU), and the signal processing unit (SPU) are located in the ITE-part, and wherein the first input transducer (microphone (IT1)) is located in a body worn part (BW) (e.g. a BTE-part) and connected to antenna and transceiver circuitry (together denoted Tx/Rx) for wirelessly transmitting the electric microphone signal IN1' to the ITE-part via wireless link WL. The wireless connection (WL) may in another embodiment be substituted by a wired connection. Preferably, the body-worn part (BW) is adapted to be located at a place on the user's body that is attractive from a sound reception point of view, e.g. on the user's head. The ITE-part comprises the second input transducer (microphone IT2), and antenna and transceiver circuitry (together denoted Rx/Tx) for receiving the wirelessly transmitted electric microphone signal IN1' from the BW-part (providing received signal IN1). The (first) electric input signal IN1, and the second electric input signal IN2 are connected to the signal unit (SPU). The signal processing unit (SPU) processes the electric input signals and provides a processed output signal (OUT), which is forwarded to output transducer OT (here a loudspeaker) and converted to an output sound. The wireless link WL between the BW- and ITE-parts may be based on any appropriate wireless technology. In an embodiment, the wireless link is based on an inductive (near-field) communication link. In a first embodiment, the BW-part and the ITE-part may each constitute self-supporting (independent) hearing devices. In a second embodiment, the ITE-part may constitute self-supporting (independent) hearing device, and the BW-part is an auxiliary device that is added to provide extra functionality. In an embodiment, the extra functionality may include one or more microphones of the BW-part to provide directionality and/or alternative input signal(s) to the ITE-part. In an embodiment, the extra functionality may include added connectivity, e.g. to provide wired or wireless connection to other devices, e.g. a partner microphone, a particular audio source (e.g. a telephone, a TV, or any other entertainment sound track).

Figure 2A:
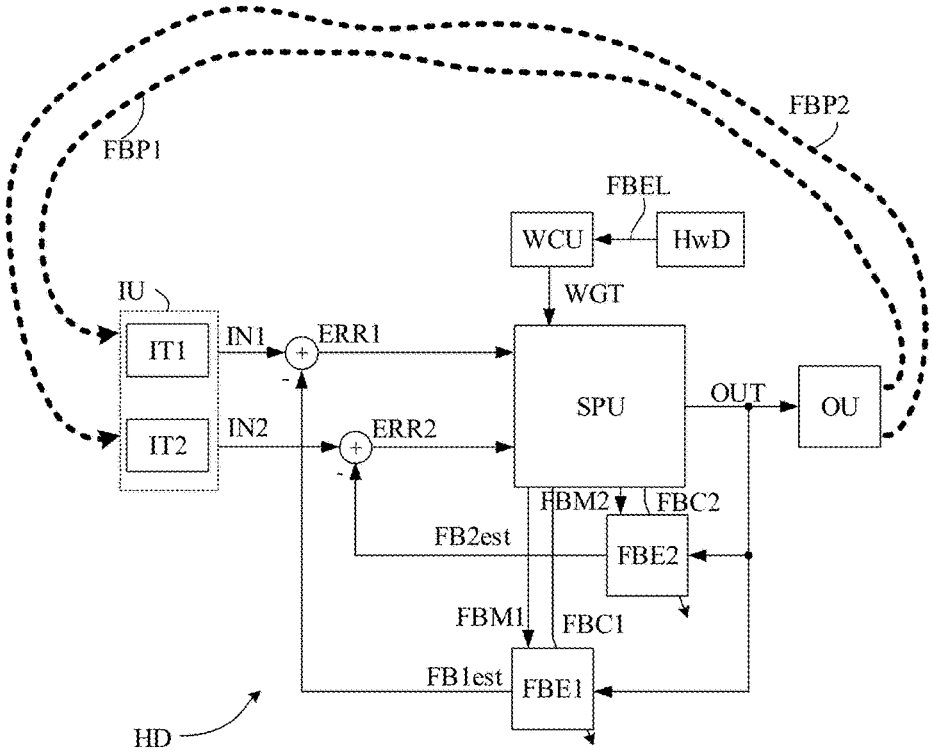
FIG. 2A shows a fifth embodiment of a hearing device comprising a feedback detection unit, a weight control unit, and a first dynamic feedback cancellation system according to the present disclosure.
Figure 2B:
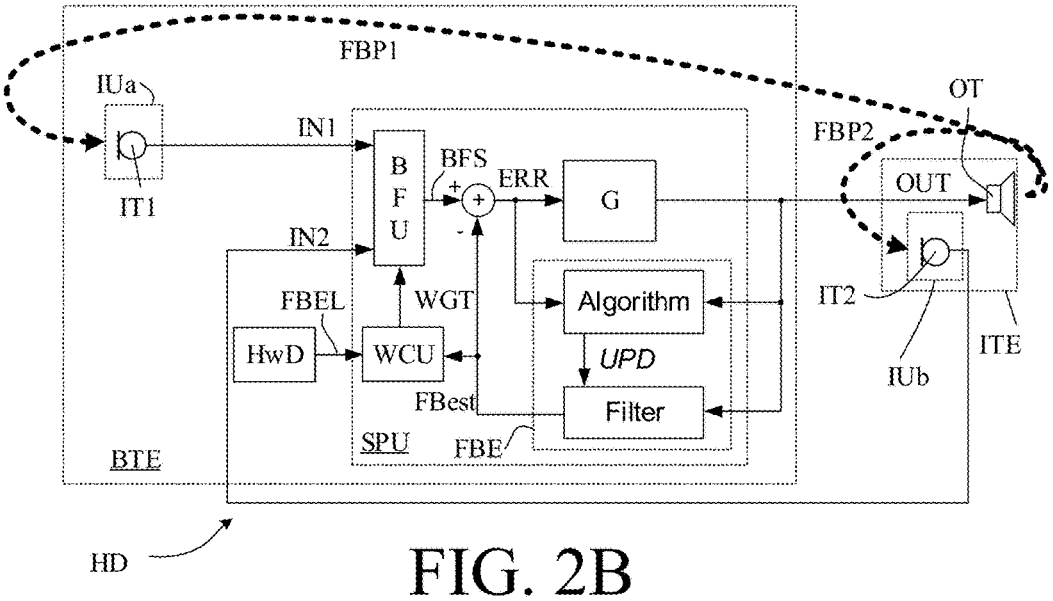
FIG. 2B shows a sixth embodiment of a hearing device comprising a feedback detection unit, a weight control unit, and a second dynamic feedback cancellation system according to the present disclosure.

FIG. 2A shows an embodiment of a hearing device (HD), e.g. a hearing aid, comprising a forward path from an input unit (IU) to an output unit (OU) and including a signal processing unit (SPU) there between. The hearing device comprises a feedback detection unit (HwD), a weight control unit (WCU), and a first dynamic feedback cancellation system according to the present disclosure. Each input transducer ITi (i=1, 2) has its separate feedback cancellation system comprising a feedback estimation unit FBEi (i=1, 2) providing estimate signals FBEiest (i=1, 2) representing estimates of the respective feedback paths, FBPi (i=1, 2), and a combination unit (e.g. sum unit '+') for subtraction of the feedback path estimate signal FBEiest from the electric input signal INi and providing a resulting feedback corrected input signal ERRi (i=1, 2) (often termed the 'error signal'). The feedback path estimate signals FBEiest are based on the output signal (OUT) and respective control signals (FBCi) (i=1, 2) from the signal processing unit (SPU) (e.g. based on the error signal ERRi). In the embodiments of FIGS. 2A and 2B, each of the feedback estimation units FBEi (i=1, 2) receives a further control input FBMi (i=1, 2) from the signal processing unit (SPU), e.g. based on the feedback measure FBEL from the howl detector (HwD) to control parameters of the respective feedback estimation units, e.g. an update frequency, an adaptation rate, an activation or deactivation, etc.

The embodiment of FIG. 2B is equivalent to the embodiment of FIG. 2A apart from the fact that only a single feedback estimation unit (FBE) and associated combination unit ('+') working on the beamformed signal BFS from the beamformer unit (BFU) is indicated. The embodiment of FIG. 2B is further partitioned in a BTE- and an ITE-part as described in connection with FIG. 1C.

The embodiments of FIGS. 2A and 2B may be operated fully or partially in the time domain, or fully or partially in the time-frequency domain (by inclusion of appropriate time-to-time-frequency and time-frequency-to-time conversion units, cf. e.g. FIG. 1B).

Figure 3:
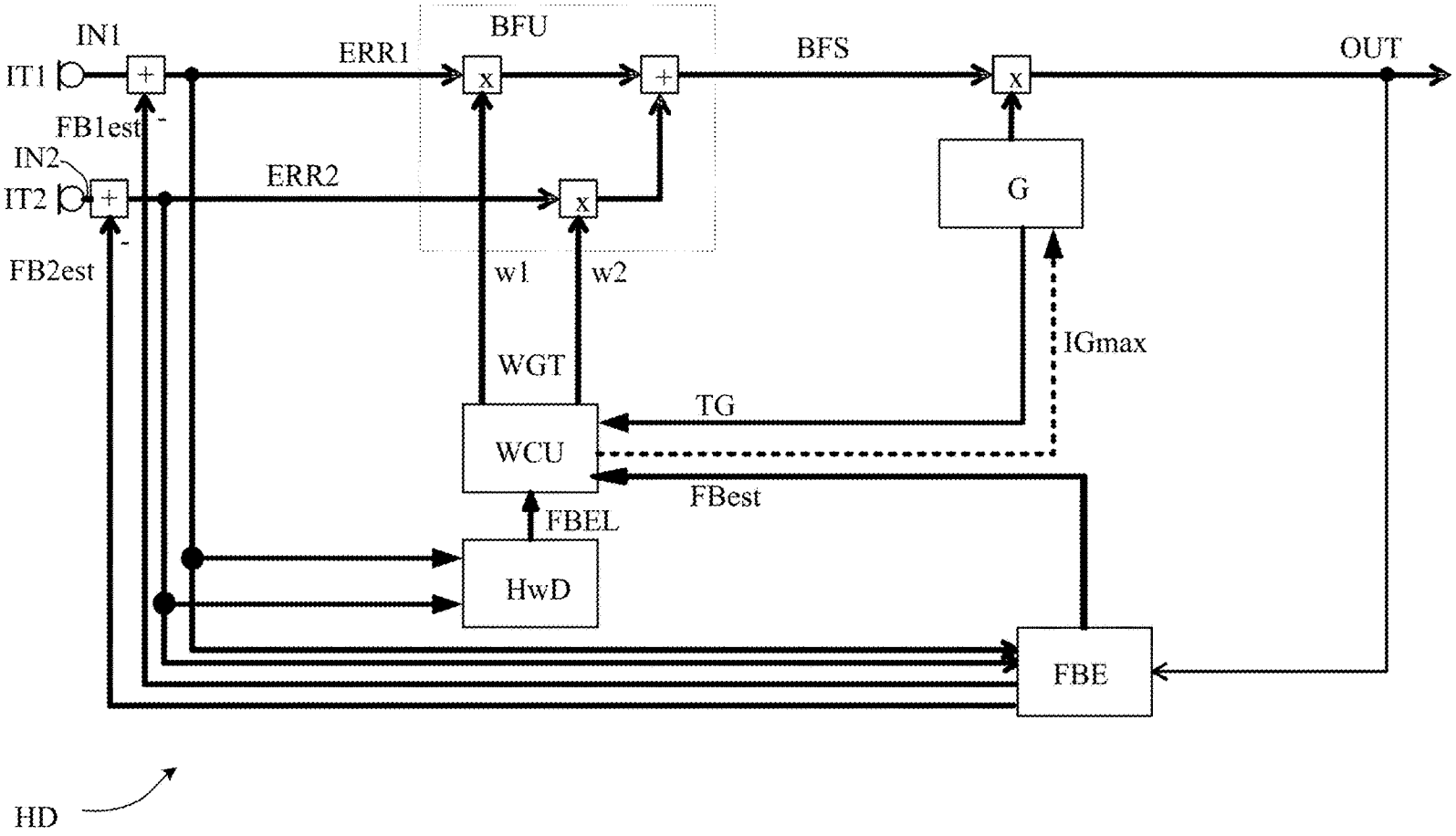
FIG. 3 shows a seventh embodiment of a hearing device comprising a feedback detection unit, a weight control unit, and a dynamic feedback cancellation system according to the present disclosure, FIG. 4A schematically illustrates a first exemplary distribution of gain between first and second input transducers of an embodiment of a hearing device according to the present disclosure, FIG. 4B schematically illustrates a second exemplary distribution of gain between first and second input transducers of an embodiment of a hearing device according to the present disclosure, FIG. 4C schematically illustrates a third exemplary distribution of gain between first and second input transducers of an embodiment of a hearing device according to the present disclosure, FIG. 4D schematically illustrates a fourth exemplary distribution of gain between first and second input transducers of an embodiment of a hearing device according to the present disclosure, FIG. 4E schematically illustrates a fifth exemplary distribution of gain between first and second input transducers of an embodiment of a hearing device according to the present disclosure FIG. 4F schematically illustrates a sixth exemplary distribution of gain between first and second input transducers of an embodiment of a hearing device according to the present disclosure.
Figure 7A:
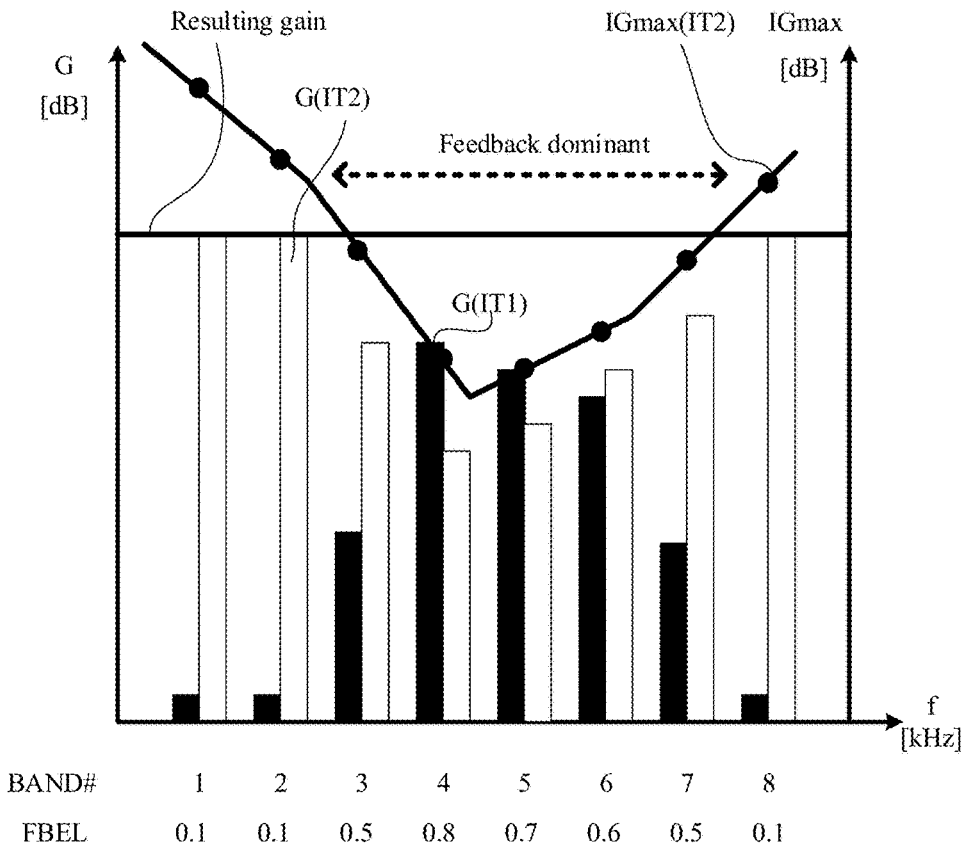
FIG. 7B shows an embodiment of a hearing device according to the present disclosure suitable for implementing the weighting scheme of FIG. 7A.
Figure 7B:
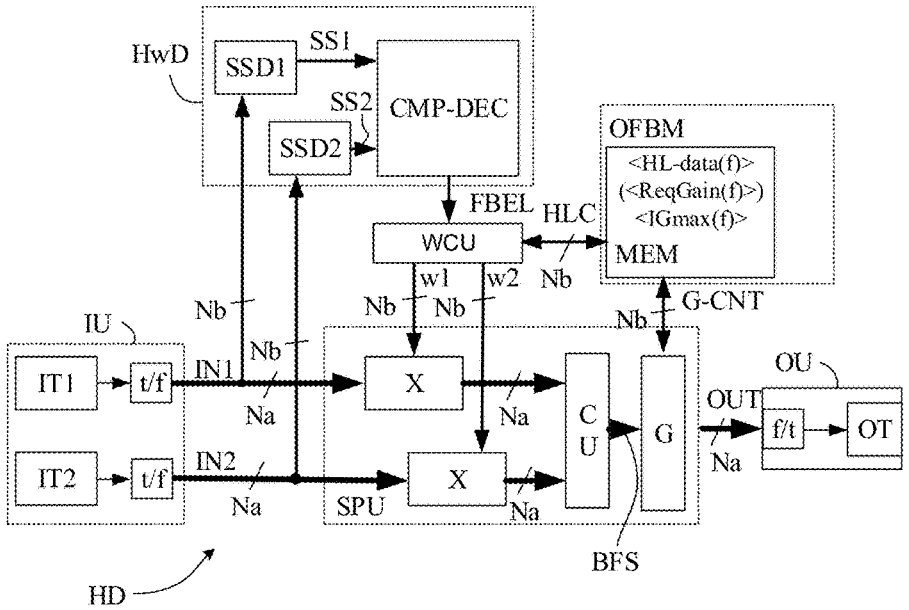

In the embodiment of FIG. 2B, the signal processing unit SPU of the BTE-part comprises a beamforming unit (BFU) for applying (e.g. complex valued, e.g. frequency dependent) weights (WGT; or w1, w2 as in FIGS. 3 and 7B) to the first and second electric input signals IN1 and IN2, providing a (e.g. complex) weighted combination (e.g. a weighted sum) of the input signals and providing a resulting beamformed signal BFS (BFS=w1*IN1+w2*IN2) via a combination unit (CU), cf. e.g. FIG. 7B or the sum unit '+' in the beamforming unit (BFU) in FIG. 3. The beamformed signal (BFS) is fed to gain control unit G for further enhancement (e.g. noise reduction, feedback suppression, etc.) and amplification (or attenuation) (including application of a frequency dependent gain intended for compensating for a user's hearing impairment). The feedback paths from the output transducer (OT) to the respective input transducers IT1 and IT2, are denoted FBP1 and FBP2, respectively (cf. bold, dotted arrows). The feedback signals are mixed with respective signals from the environment (when picked up by the input transducers). In a normal situation (considering the location of the output transducer relative to the input transducers), the feedback signal at the (second) input transducer IT2 of the ITE-part will be far larger than the feedback signal arriving at the (first) input transducer IT1 of the BTE part. This difference may be utilized to identify feedback as described in the present disclosure. The beamformer unit (BFU), however, may comprise first (far-field) adjustment units configured to compensate the electric input signals IN1, IN2 for the different location relative to an acoustic source from the far field (e.g. according to the microphone location effect (MLE)). The first input transducer is e.g. arranged in the BTE-part to be located behind the pinna (e.g. at the top of pinna), whereas the second input transducer is located in or around the entrance to the ear canal. Thereby a maximum directional sensitivity of the beamformed signal may be provided in a direction of a target signal from the environment (cf. also FIG. 6A, 6B). Similarly, the beamformer unit (BFU) may comprise second (acoustic near-field) adjustment units to compensate the electric input signals IN1, IN2 for the different location relative to an acoustic source from the near-field (e.g. from the output transducer located in the ear canal). Thereby a minimum directional sensitivity of the beamformed signal may be provided in a direction of the output transducer (OT).

The hearing device (HD), e.g. the feedback detection unit (HwD), is configured to control the beamformer unit (BFU) and/or the gain control unit (G) in dependence of the feedback measure (FBEL). In an embodiment, one or more weights (e.g. frequency dependent weights w1(*f*), w2(*f*)) of the weighted combination of electric input signals IN1, IN2 or signals derived therefrom is/are changed in dependence of the feedback measure FBEL, e.g. in that the weights of the beamformer unit are changed to change en emphasis of the beamformer unit (BFU) from one electric input signal to another in dependence of the feedback measure (e.g. at a frequency band level). In an embodiment, the feedback detection unit (HwD) is configured to control the weight control (WCU) or beamformer unit (BFU) to increase the weight (w1) of the first electric signal IN1 in the beamformed signal BFS in case the feedback measure (FBEL) indicates that the current acoustic situation is dominated by feedback (e.g. $|SS2-SS1|>FB_{TH}$, see e.g. FIGS. 7A, 7B).

The hearing device, e.g. the feedback detection unit (HwD), may further be configured to control the gain control unit (G) in dependence of the feedback measure (FBEL). In an embodiment, the hearing device is configured to decrease the applied gain based on an indication by the howl detector that the current acoustic situation is dominated by feedback (e.g. at a frequency band level).

The BTE-part of the embodiment of FIG. 2B comprises a feedback suppression (cancellation) system comprising a feedback estimation unit (FBE). The feedback estimation unit (FBE) comprises an adaptive filter comprising an adaptive algorithm part (Algorithm) for determining update filter coefficients, which are fed (signal UPD) and applied to a variable filter part (Filter) of the adaptive filter. The feedback suppression system further comprises a combination unit (+) wherein an estimate of the current feedback path FBest is subtracted from the resulting input signal BFS from the beamformer unit (BFU) and the resulting (feedback reduced) 'error' signal ERR is fed to the gain control unit G for further processing and to the algorithm part of the adaptive filter of the FBE-unit for use in the estimation of the feedback path. The feedback estimation unit (FBE) provides the estimate FBest of a current feedback path based on the output signal OUT from the signal processing unit and the error signal ERR (in that the adaptive algorithm minimizes the error signal ERR given the current output signal OUT). In the shown embodiment, the hearing device uses the feedback measure signal FBEL from the howl detector (HwD) to control the weights (WGT) applied to the first and second electric input signals (IN1, IN2). The feedback measure signal FBEL may further be used to influence or control the feedback estimation unit (FBE), e.g. its adaptation rate (including whether or not filter coefficients of the variable filter part (Filter) should be updated). The update of the estimate of the feedback path may preferably be disabled, when the feedback path is changing (as indicated by the feedback measure or a specific feedback change measure). In other embodiments, each of the input transducers (microphones) (IT1, IT2) have their own feedback suppression system (as e.g. illustrated in FIG. 2A), in which case feedback correction via combination units ('+') is performed before beamforming is applied.

FIG. 3 shows an embodiment of a hearing device (HD) comprising a feedback detection unit (HwD), a weight control unit (WCU), and a dynamic feedback cancellation system according to the present disclosure. The embodiment of FIG. 3 is similar to the embodiment of FIG. 2A, but the signal processing unit (SPU) of FIG. 2A is in FIG. 3 indicated in more detail to contain a beamformer unit (BFU). The beamformer unit (BFU) comprises first and second multiplication units ('×') for applying first and second complex or real (frequency dependent) weight factors (w1(*f*), w2(*f*), f being frequency, the weights being provided by the weight control unit (WCU)) to the first and second error signal (ERR1, ERR2). The beamformer unit (BFU) further comprises combination unit (sum unit, '+') for combining the weighted first and second error signals (w1*ERR1, w2*ERR2) thereby providing the beamformed signal (BFS). The weight control unit (WCU) determines the first and second weights w1, w2 on the basis of the feedback measure FBEL from the feedback detection unit (HwD), and on a feedback estimate FBest provided by feedback estimation unit (FBE), and on a target gain TG requested by the hearing loss processing unit (G). The forward path of the hearing device comprises a further combination unit (multiplication unit '×') for applying a resulting gain to provide output signal OUT. In an embodiment, the weight control unit (WCU) comprises an online feedback manager (OFBM) adapted to dynamically update a maximum allowable gain IGmax applicable to the forward path signal (cf. dotted line from the weight control unit (WCU) to the hearing loss processing unit (G). A number of exemplary distributions of gain between the first and second electric input signals are illustrated in FIG. 4A-4F.

FIG. 4A-F illustrate an exemplary intention of the dual microphone weight control unit (WCU) comprising an online feedback manager (OFBM) according to the present disclosure. Each drawing shows a distribution of stable gain relative to unstable gain (resulting in howl) for the first and second input transducers (IT1, IT2) at a given target gain and in a given feedback situation. FIG. 4A, 4B, 4C illustrate scenarios in embodiments of a hearing device without a feedback cancellation system (or in modes of operation, where such system is disabled). FIG. 4D, 4E, 4F illustrate scenarios in embodiments of a hearing device comprising a feedback cancellation system (in modes of operation, where such system is enabled). Thereby an increased gain margin GM is provided. The increased amount of 'stable gain' provided by the feedback cancellation system is indicated in FIG. 4D to 4F by the (dark grey) ranges denoted DFC.

The dual microphone WCU/OFBM is e.g. adapted to work in separate frequency bands (so each of the drawings FIG. 4A-4F may represent a given frequency band).

FIG. 4A shows a system with two input transducers (e.g. microphones) IT1 and IT2, where the gain can be distributed between them to achieve the desired target gain (TG). The resulting gain of the microphone beamformer block BFU is BFS(f,t)=IN1(*f,t*)*W1(*f,t*)+IN2(*f,t*)*W2(*f,t*), where W1(*f,t*) and W2(*f,t*) are frequency and time dependent (complex or real) weights. In the current system it is desired to have as much as possible gain on the 'front microphone' (IT2, located at or in the ear canal). That is possible, if the limit where the loop gain (LG2) of the front microphone (IT2) is 0 dB (LG2=0) is higher than the target gain (TG). In that case, the gain margin GM2 is positive. The beamformed signal BFS(f,t) (cf. e.g. FIG. 3) may e.g. be set equal to IN2(*f,t*) (W1=0, W2=1), which (advantageously) can provide the full target gain (TG) (without a risk of howl).

FIG. 4B illustrates a situation where the gain margin of IT2 is negative due to more feedback (GM2<0). In this case, the target gain (TG) is higher than the stable gain for IT2 (without howl). The solution is then to lower the gain on IT2 to a level lower than where LG2=0 dB. The gain on the other input transducer (IT1) is then raised to achieve the target gain (TG). Hence BFS=IN1*W1+IN2*W2. The reduced gain margin GM2 on IT2 may e.g. be detected by the feedback detection unit, and/or by a feedback path estimation system.

FIG. 4C shows a situation where the feedback on the second input transducer IT2 located at or in the ear canal is very critical. In such case, a significant part (or most) of the gain is preferably placed on the first input transducer IT1 located behind the ear (until the gain margin on IT2 allows to increase the gain again). This situation could be when a phone is placed near the ear, which increases the acoustical feedback to the microphone located at or in the ear.

FIG. 4D illustrates a setup where the system includes a feedback cancellation system (e.g. a Dynamic Feedback Control system (DFC), e.g. comprising an online feedback manager), that can increase the possible max gain (MG2) of the second input transducer (IT2) without the (undesired) side effect of creating howl. In this case, the gain on IT2 can exceed the LG2=0 limit (without DFC) into the (stable gain) range of the DFC system.

FIG. 4E shows a situation where the feedback increases (could be the 'phone at the ear' situation). In this case, the stable gain on both microphone decreases, and the performance of the DFC system decreases. In this situation the gain is shifted more to the first input transducer IT1 (until the feedback cancellation system has converged to a feedback estimate that reflects the new feedback path).

FIG. 4F shows a situation where the slower working DFC system has adjusted to the new feedback path. In this case, then the gain on the second input transducer IT2 can be increased to a higher level, below MG2, and the gain on the first input transducer IT1 is lowered to match the target gain TG.

Figure 5A:
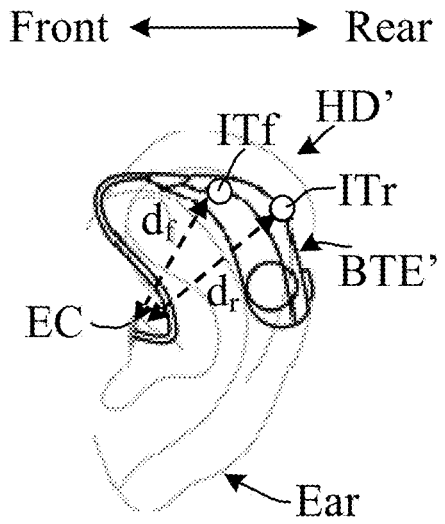
FIG. 5A shows the location of microphones relative to the ear canal and ear drum for a typical two-microphone BTE-style hearing aid, FIG. 5B schematically illustrates the location of first and second microphones relative to the ear canal and ear drum for a first embodiment of a two-microphone M2RITE-style hearing aid according to the present disclosure.

FIG. 5A schematically illustrates the location of microphones (ITf, ITr) relative to the ear canal (EC) and ear drum for a typical (prior art) two-microphone BTE-style hearing aid (HD'). The hearing aid HD' comprises a BTE-part (BTE') comprising two input transducers (ITf, ITr) (e.g. microphones) located (or accessible for sound) in the top part of the housing (shell) of the BTE-part (BTE'). When mounted at (e.g. behind) a user's ear (or pinna) (Ear), the microphones (ITf, ITr) are located so that one (ITf) is more facing the front (cf. arrow denoted Front in FIG. 5A) and one (ITr) is more facing the rear of the user (cf. arrow denoted Rear in FIG. 5A). The two microphones are located a distance df and dr, respectively, from the entrance of the ear canal (EC). The two distances are of similar size (e.g. within 50% or 20%, or 10%) of each other.

Figure 5C:
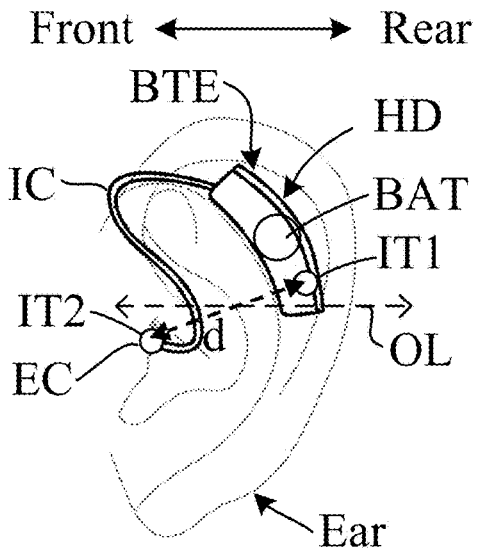
FIG. 5C shows a second embodiment of a two-microphone M2RITE-style hearing aid according to the present disclosure.
Figure 5B:
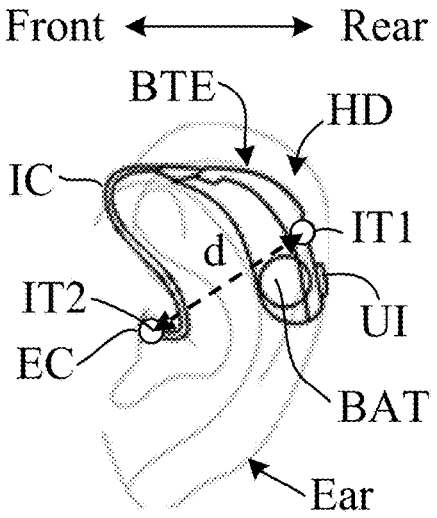
FIG. 5D shows an embodiment of a three-microphone M2RITE-style hearing aid according to the present disclosure.

FIGS. 5B and 5C schematically illustrate the location of first and second microphones (IT1, IT2) relative to the ear canal (EC) and ear drum for two embodiments of a two-microphone M2RITE-style hearing aid (HD) according to the present disclosure. One microphone (IT2) is located (in an ITE-part) at the ear canal entrance (EC) or retracted from the ear canal opening in a direction towards the eardrum. Another microphone (IT1) is located in or on a BTE-part (BTE) located behind an ear (Ear) of the user. The first microphone (IT1) is more facing towards the rear of the user (cf. arrow denoted Rear in FIG. 5B), whereas the second microphone (IT2) is more facing towards the front of the user (cf. arrow denoted Front in FIG. 5B). The distance between the two microphones (IT1, IT2) is indicated by d. The distance from the ear canal (EC) to the individual microphones (IT2, IT1) is thus ≈0 and d, respectively (the difference in distance to the ear canal entrance (EC) thus being d). Hence, a substantial difference in signal level (or power or energy) received by the first and second microphones (IT1, IT2) from a sound source located near the ear canal entrance (EC) (here e.g. from an output transducer of the hearing aid located in the ear canal (EC)) will be experienced. The hearing aid (HD), here the BTE-part (BTE), is shown to comprise a battery (BAT) for energizing the hearing aid, and a user interface (UI) (FIG. 5B), here a switch or button on the housing of the BTE-part. The user interface is e.g. configured to allow a user to influence functionality of the hearing aid. It may alternatively (or additionally) be implemented in a remote control device (e.g. as an APP of a smartphone or similar device).

The embodiments of a hearing device shown in FIGS. 5B and 5C comprise e.g. the same functional parts as the embodiment shown in FIG. 1A-D. The BTE-housing and location of components differ between the embodiments of FIGS. 5B and 5C. In the embodiment of FIG. 5C, the input transducer IT1 is located on the lower part of the housing (where the battery is situated in the embodiment of FIG. 5B). Hence, in the embodiment of FIG. 5C, the battery is moved more to towards the middle of the body of the BTE-housing, as reflected by the increased dimension of the middle part of the housing. Thereby the embodiment of FIG. 5C is more easily configured to provide that the two input transducers (IT1, IT2) are located along a substantially horizontal line when the hearing device is mounted at the ear of the user in a normal, operational state (cf. e.g. input transducers IN1, IN2 and dashed, double arrowed line OL in FIG. 5C). This has the advantage of facilitating beamforming of the electric input signals from the input transducers in an appropriate (horizontal) direction, e.g. the 'look direction' of the user.

Figure 5D:
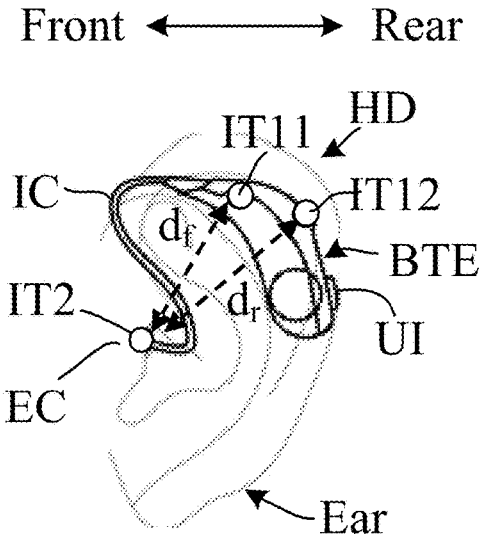

FIG. 5D shows an embodiment of a three-microphone M2RITE-style hearing aid according to the present disclosure. FIG. 5D schematically illustrates the location of first, second and third microphones (IT11, IT12, IT2) relative to the ear canal (EC) and ear drum for a three-microphone hearing aid (HD) according to the present disclosure (and as e.g. shown and described in connection with FIG. 6B). The embodiment of FIG. 5D provides a hybrid solution between a prior art two-microphone solution with two microphones (IT11, IT12) located on a BTE-part (as shown in FIG. 5A) and a one- (MRITE, not illustrated) or two-microphone (M2RITE) solution comprising a microphone (IT2) located at the ear canal (where the two microphone solution is illustrated in FIG. 5B, 5C).

FIGS. 6A and 6B show first and second embodiments of an M2RITE style hearing device according to the present disclosure.

FIGS. 6A and 6B each shows an exemplary hearing device according to the present disclosure. The hearing device (HD), e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising an output transducer (OT), e.g. a receiver (loudspeaker). The BTE-part and the ITE-part are connected (e.g. electrically connected) by a connecting element (IC) and internal wiring in the ITE- and BTE-parts (cf. e.g. schematically illustrated as wiring Wx in the BTE-part). The BTE- and ITE-parts each comprise an input transducer, IT1 and IT2, respectively, which are used to pick up sounds from the environment of a user wearing the hearing device. In an embodiment, the ITE-part is relatively open allowing air to pass through and/or around it thereby minimizing the occlusion effect perceived by the user. In an embodiment, the ITE-part of a M2RITE-style according to the present disclosure is less open than a typical RITE-style comprising only a loudspeaker (OT) and a dome (DO) to position the loudspeaker in the ear canal. In an embodiment, the ITE-part of a M2RITE-style according to the present disclosure comprises a mould and is intended to allow a relatively large sound pressure level to be delivered to the ear drum of the user (e.g. a user having a severe-to-profound hearing loss).

In the embodiments of a hearing device (HD) in FIGS. 6A and 6B, the BTE part comprises an input unit comprising one or more input transducers (e.g. microphones) (in FIG. 6A, one, $IT_1$, and in FIG. 6B, two, $IT_{11}$, $IT_{12}$) each for providing an electric input audio signal representative of an input sound signal. The input unit further comprises two (e.g. individually selectable) wireless receivers ($WLR_1$, $WLR_2$) for providing respective directly received auxiliary audio input and/or control or information signals. The BTE-part comprises a substrate SUB whereon a number of electronic components (WCU, HwD, SPU) are mounted, including a feedback detection unit/howl detector HwD for providing a feedback measure indicative of current acoustic feedback The BTE-part further comprises a weight control unit (WCU) configured to control or influence first and second weights applied to the first and second electric input signals in dependence of a measure of the current level of feedback. The BTE-part further comprises a configurable signal processing unit (SPU) comprising a processor and memory and adapted for selecting and processing one or more of the electric input audio signals and/or one or more of the directly received auxiliary audio input signals, based on a currently selected (activated) hearing aid program/parameter setting/(e.g. either automatically selected based on one or more sensors and/or on inputs from a user interface). The configurable signal processing unit (SPU) provides an enhanced audio signal. In an embodiment, the signal processing unit (SPU), the howl detector (HwD) and the weight control unit (WCU) all form part of an integrated circuit, e.g. a digital signal processor.

The hearing device (HD) further comprises an output unit (OT, e.g. an output transducer) providing an enhanced output signal as stimuli perceivable by the user as sound based on the enhanced audio signal from the signal processing unit or a signal derived therefrom. Alternatively or additionally, the enhanced audio signal from the signal processing unit may be further processed and/or transmitted to another device depending on the specific application scenario.

In the embodiment of a hearing device in FIGS. 6A and 6B, the ITE part comprises the output unit in the form of a loudspeaker (receiver) (OT) for converting an electric signal to an acoustic signal. The ITE-part also comprises the (second) input transducer ($IT_2$, e.g. a microphone) for picking up a sound from the environment. In addition, the (second) input transducer ($IT_2$) may—depending on the acoustic environment—pick up more or less sound from the output transducer (OT) (unintentional acoustic feedback). The ITE-part further comprises a guiding element, e.g. a dome or mould, (DO) for guiding and positioning the ITE-part in the ear canal of the user.

The hearing device of FIG. 6A may represent an M2RITE style hearing aid containing two input transducers (IT1, IT2, e.g. microphones) adapted to provide that one (IT2, in the ITE-part) is located in or at the ear canal of a user and the other (IT1, in the ITE-part) elsewhere at the ear of the user (e.g. behind the ear (pinna) of the user), when the hearing device is operationally mounted on the head of the user. In the embodiment of FIG. 6A, the hearing device is configured to provide that the two input transducers (IT1, IT2) are located along a substantially horizontal line (OL) when the hearing device is mounted at the ear of the user in a normal, operational state (cf. e.g. input transducers IN1, IN2 and dashed, double arrowed line OL in FIG. 6A). This has the advantage of facilitating beamforming of the electric input signals from the input transducers in an appropriate (horizontal) direction, e.g. in the 'look direction' of the user (e.g. towards a target sound source).

The embodiment of a hearing device shown in FIG. 6B is largely identical to the embodiment shown in FIG. 6A except for the following differences. The embodiment of a hearing device shown in FIG. 6B comprises three input transducers ($IT_{11}$, $IT_{12}$, $IT_2$) (instead of two in FIG. 6A). In the embodiment of FIG. 6B, the input unit is shown to contain exactly three input transducers ($IT_{11}$, $IT_{12}$, $IT_2$), two in the BTE-part ($IT_{11}$, $IT_{12}$) and one ($IT_2$) in the ITE part. In the embodiment of FIG. 6B, the two 'first' input transducers $IT_{11}$, $IT_{12}$ of the BTE-part are located in a typical state of the art BTE manner, so that—during wear of the hearing device—the two input transducers (e.g. microphones) are positioned along a horizontal line pointing substantially in a look direction of the user at the top of pinna (whereby the two input transducers in FIG. 6B can be seen as 'front' ($IT_{11}$) and 'rear' ($IT_{12}$) input transducers, respectively). The location of the three microphones has the advantage that a directional signal based on the three microphones can be flexibly provided. In an embodiment, the hearing device comprises a beamformer unit for combining the two electric input signals from the two first input transducers $IT_{11}$, $IT_{12}$ and providing a beamformed signal. In an embodiment, the beamformed signal may be considered as (or constitute) the first electric input signal and used together with the second electric input signal as input to a weighting unit, whose weights are controlled by the feedback measure as described in the present disclosure.

The hearing device, e.g. the signal processing unit (SPU), comprises e.g. a feedback cancellation system for reducing or cancelling feedback from the output transducer (OT) to the (second) input transducer ($IT_2$) and/or to the (first) input transducer ($IT_1$) of the BTE-part (cf. e.g. FIG. 2A, 2B). The feedback cancellation system may preferably be controlled or influenced by the feedback measure.

The hearing device (HD) exemplified in FIGS. 6A and 6B is a portable device and further comprises a battery (BAT), e.g. a rechargeable battery, for energizing electronic components of the BTE- and ITE-parts. The hearing device of FIGS. 6A and 6B may in various embodiments implement the embodiments of a hearing device shown in FIG. 1A, 1B, 1C, 1D, FIG. 2A, 2B, FIG. 3, and FIG. 7B, respectively.

In an embodiment, the hearing device, e.g. a hearing aid (e.g. the signal processing unit SPU), is adapted to provide a frequency dependent gain and/or a level dependent compression and/or a transposition (with or without frequency compression) of one or frequency ranges to one or more other frequency ranges, e.g. to compensate for a hearing impairment of a user.

FIG. 7A schematically illustrates the use of the feedback measure (FBEL) to control weights (w1, w2) of a beamformer in a number frequency bands. The feedback measure FBEL, which (in this embodiment) takes on values in the interval between 0 and 1, is shown as a function of frequency f [kHz] or frequency bands BAND# (1-8). Eight frequency bands are assumed to span the relevant frequency range (e.g. between 0 and 8 or 10 kHz or more). Any other number of frequency bands may be used, e.g. 4 or 16 or 64 or more. A value of FBEL equal to or above 0.5 is taken to indicate an acoustic situation wherein feedback is dominant. A value of FBEL below 0.5 is taken to indicate an acoustic situation wherein feedback is NOT dominant. The top, piecewise linear graph schematically illustrates a maximum allowable gain IGmax(IT2) for the second input transducer IT2 (e.g. located in or at an ear canal of the user, IGmax-values being e.g. provided by predefined values stored in a memory or by an online feedback manager, OFBM). IGmax depends on the hearing aid style, and the current feedback (and an intended feedback margin). A frequency range where feedback is dominant is indicated in FIG. 7A by a dotted double arrow denoted 'Feedback dominant' (covering bands 3-7, e.g. corresponding to a frequency range between 2 and 4 kHz). In this frequency range, the maximum allowable gain IGmax(IT2) is decreased (to avoid that loop gain (=IGmax+FB, in logarithmic representation, FB being feedback gain) becomes too large (e.g. >0 dB), which may result in howl. The frequency range where feedback is dominant is further indicated by the feedback measure FBEL being larger than or equal to 0.5 (see lower part of FIG. 7A). A requested resulting gain (target gain) of the second input transducer IT2 is schematically indicated by the solid horizontal line denoted 'Resulting gain'. The frequency dependent control of the weights, w1(*f*), w2(*f*), of the first and second input transducers IT1, IT2, respectively, as contributers to a beamformed signal (BFS in FIG. 2B, 3) is indicated in FIG. 7A by the bar diagram in the middle of FIG. 7A, where a value of the frequency dependent gain is indicated. The black bar illustrates a gain G(IT1,f) applied to the signal from the first input transducer IT1 (the first electric input signal), and the white bar illustrates a gain G(IT2,f) applied to the signal from the second input transducer IT2 (the second electric input signal). In frequency bands NOT dominated by feedback (Band#1, 2 and 8), emphasis is given to the second electric input signal (from IT2) providing the full requested gain (TG in FIG. 4A-F). In frequency bands dominated by feedback (Band#3-7), emphasis is moved from the signal from the second (IT2) to the signal from the first (IT1) input transducer in that gain G(IT2) applied to the signal from the second (ear canal) input transducer IT2 is reduced to a value providing a predefined margin to the maximum allowable gain IGmax(IT2) and the gain G(IT1) applied to the signal from the first input transducer IT1 is increased to compensate for the reduction in gain G(IT2). Thereby a flexible and robust system that utilizes the advantages of the location of the second input transducer (e.g. in the ear canal) in acoustic situations where feedback is absent (or NOT dominant), and avoids howl in acoustic situations dominated by feedback (to the second input transducer) by increasing emphasis of the signal from the first input transducer (e.g. located behind an ear of the user), while still providing the requested gain to the user. This strategy based on the feedback measure FBEL provided by the howl detector (HwD) may be used on a broadband (time-domain) signal as well as on a band split (time-frequency domain) signal as schematically illustrated in FIG. 7A.

FIG. 7B shows an embodiment of a hearing device (HD) according to the present disclosure suitable for implementing the weighting scheme of FIG. 7A. The embodiment of a hearing device of FIG. 7B is equivalent to the embodiment shown and discussed in connection with FIG. 1B comprising a forward path in the frequency domain (Na frequency bands) and an analysis path in the frequency domain (Nb frequency bands, Nb being e.g. less than or equal to Na). Additionally, the howl detector (HwD) comprises an online feedback manager (OFBM) comprising a memory (MEM) wherein frequency dependent hearing loss data (<HL-data (f)> in FIG. 7B) (and/or a requested frequency dependent gain ReqGain(f) derived therefrom) for the user are or can be stored. Additionally, measured or (e.g. dynamically) estimated frequency dependent maximum allowable gain data (<IGmax(f)> in FIG. 7B) are stored (e.g. based on the current hearing aid style, feedback path estimates, etc.). The feedback detection unit (HwD) is in communication with the memory (MEM) via signal HLC allowing the feedback detection unit to read from and write to the memory (either directly or as here, via the weight control unit (WCU)). Based on the current values of the feedback measure FBEL (see e.g. bottom part of FIG. 7A), the currently stored values of IGmax (which may be predefined, or dynamically updated), and the presently determined resulting gains (cf. FIG. 7A (typically frequency dependent, though) based on the current input signal, user dependent gain data (ReqGain (f)) (and possibly on the applied processing algorithms), the 'emphasis gain values', G(IT1) and G(IT2) (cf. bar diagram in FIG. 7A) to be applied to the electric input signals IN1, IN2, can be determined in the input signal weight control unit (WCU) and applied via respective combination units ('×', here multiplication units). The signal processing unit (SPU) comprises (in addition to the input signal combination units) a combination unit (CU, e.g. a SUM unit or a weighted SUM unit (e.g. a beamformer unit, BFU) providing a resulting input signal (here beamformed signal, BFS), and possibly a processing unit (G) for applying further processing algorithms (e.g. noise reduction and/or feedback reduction) to the signal of the forward path and providing processed output signal OUT. The processing unit (G) is in communication with the online the feedback manager (OFBM, incl. memory (MEM)) via signal G-CNT allowing the processing unit to read from and write to the memory. As also indicated in FIG. 1B, FIG. 7B is assumed to operate fully or partially in the time-frequency domain. The embodiment of FIG. 7B may e.g. comprise a feedback cancellation system, e.g. as shown in embodiments of FIG. 2A, 2B, or FIG. 3.

In the embodiment, of FIG. 7B, the signal strength (SS1, SS2, e.g. level/magnitude) of each of the electric input signals (IN1, IN2) may be estimated by individual signal strength detectors (cf. SSD1, SSD2 in FIG. 7B) and their outputs used in the comparison unit (cf. CMP-DEC in FIG. 7B) to determine a comparison measure indicative of the difference between said signal strength estimates and based thereon a feedback measure FBEL is provided to the weighting unit WCU.

Embodiments of a feedback detector providing a feedback measure based on level differences between the first and second input transducers is described in our co-pending European patent application 15201835.4 with the title 'A hearing device comprising a feedback detector', filed at the EPO on 22 Dec. 2015, which is incorporated herein by reference.

Alternative microphone positions to the ones mentioned in the above examples may also be considered without deviating from the concepts of the present disclosure. E.g. one microphone in the ear and one on top of the ear. One microphone on the speaker wire and one microphone behind the ear. E.g. one or two microphones in the ear and two or more microphones behind (e.g. on the top f) the ear, or elsewhere on the user's body, etc.

The idea may e.g. be expanded to work binaurally, so when a hearing aid on one side of the head has unstable feedback the gain is reduced, and the sound from the hearing aid on the other side of the head is streamed to the first side, until the feedback situation is stable again.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

WO2008151970A1 (OTICON) 18 Dec. 2008
EP2843971A1 (OTICON) 4 Mar. 2015
EP2947898A1 (OTICON) 25 Nov. 2015

The invention claimed is:

1. A hearing device adapted for being arranged at least partly on a user's head or at least partly implanted in a user's head, the hearing device comprising an input unit for providing a multitude of electric input signals representing sound, the input unit comprising a first input transducer for picking up a sound signal from the environment and providing a first electric input signal, the first input transducer being located on the head of the user;

a second input transducer for picking up a sound signal from the environment and providing a second electric input signal, the second input transducer being located at or in an ear canal of the user, a signal processing unit providing a processed signal based on one or more of said first and second electric input signals, the signal processing unit comprising a weighting or beamformer unit for providing a weighted or beamformed signal by applying respective first and second weights to the first and second electric input signals and combining the weighted first and second electric input signals or signals derived therefrom to the weighted or beamformed signal, and a hearing loss processing unit coupled to the weighting or beamformer unit and providing the processed signal, wherein the hearing loss processing unit is configured to determine a current level and frequency dependent target gain, and an output unit comprising an output transducer for converting said processed signal or a signal originating therefrom to a stimulus perceivable by said user as sound;

the hearing device further comprising a feedback detection unit for providing a measure, termed the feedback measure, of the current level of feedback from the output transducer to the first and/or second input transducer or a difference there between; and an input signal weight control unit configured to control or influence the first and second weights applied to the first and second electric input signals in dependence of said measure of the current level of feedback, and said current level and frequency dependent target gain, wherein the input signal weight control unit is configured to control the first and second weights to avoid howl while providing the current level and frequency dependent target gain.

2. A hearing device according to claim 1 comprising a BTE-part adapted to be worn at or behind an ear of the user, and an ITE-part adapted to be located at or in an ear canal of the user.

3. A hearing device according to claim 2, wherein the first input transducer is located in the BTE-part, and wherein the second input transducer is located in the ITE-part.

4. A hearing device according to claim 1 comprising a time to time-frequency conversion unit allowing the processing of signals in the (time-)frequency domain.

5. A hearing device according to claim 4 wherein the input signal weight control unit is configured to control or influence the first and second weights applied to the first and second electric input signals in dependence of a predefined maximum gain to be applied in a given frequency band, such predefined maximum gain being either determined in advance of use or dynamically during use of the hearing device.

6. A hearing device according to claim 1 wherein the feedback detection unit comprises a first signal strength detector for providing a signal strength estimate of the first electric input signal, and a second signal strength detector for providing a signal strength estimate of the second electric input signal, a comparison unit coupled to the first and second signal strength detectors and configured to compare the signal strength estimates of the first and second electric input signals and to provide a signal strength comparison measure indicative of the difference between said signal strength estimates;

a decision unit for providing the feedback measure indicative of current acoustic feedback from said output transducer to said first and/or second input transducer based on said signal strength comparison measure.

7. A hearing device according to claim 6 wherein the decision unit is configured to apply a feedback difference threshold to make a binary distinction between a feedback dominant and non-feedback dominant acoustic situation.

8. A hearing device according to claim 7 wherein the feedback difference threshold is predetermined.

9. A hearing device according to claim 7 wherein the feedback difference threshold is between 5 dB and 25 dB.

10. A hearing device according to claim 1 wherein the feedback detection unit is configured to provide an estimated level of current acoustic feedback.

11. A hearing device according to claim 1 comprising a feedback cancellation system for reducing the acoustic or mechanical feedback from the output transducer to the first and/or second input transducer.

12. A hearing device according to claim 11 configured to estimate a current feedback path from the output transducer to the first and/or second input transducer and to subtract said estimate of the current feedback path from the respective first and/or second electric input signals to provide respective feedback corrected electric input signals.

13. A hearing device according to claim 1 wherein the input signal weight control unit is configured to increase the weight of the first electric signal and/or to decrease the weight of the second electric signal in the weighted or beamformed signal in case the feedback measure indicates that the current acoustic situation is dominated by feedback.

14. A hearing device according to claim 1 comprising a hearing aid, a headset, an active ear protection device or a combination thereof.

15. A hearing device according to claim 1 wherein the feedback detector is configured to determine when the current level, and/or a change of the current level and/or a rate of change of the current level of feedback is above respective predefined feedback and feedback change threshold values, and to provide a feedback change measure indicative thereof.

16. A hearing device according to claim 15 configured to provide that an update of said estimate of the current feedback path is disabled in dependence of said feedback change measure.

17. A hearing device according to claim 1 wherein the weighting or beamformer unit comprises first, far-field adjustment units configured to compensate the electric input signals for the different location relative to an acoustic source from the far field, whereby a maximum directional sensitivity of the weighted or beamformed signal may be provided in a direction of a target signal from the environment.

18. A hearing device according to claim 1 wherein the weighting or beamformer unit comprises second, near-field adjustment units to compensate the electric input signals for the different location relative to an acoustic source from the near-field, whereby a minimum directional sensitivity of the weighted or beamformed signal may be provided in a direction of the output transducer.

19. A hearing device according to claim 1 wherein said first and second input transducers comprises or are constituted by respective microphones.

* * * * *